US006742574B2

(12) United States Patent
Sugito et al.

(10) Patent No.: US 6,742,574 B2
(45) Date of Patent: Jun. 1, 2004

(54) COOLING APPARATUS

(75) Inventors: Hajime Sugito, Kariya (JP); Hiroyuki Osakabe, Kariya (JP); Shinichi Morihira, Kariya (JP); Takaki Okochi, Kariya (JP); Yuhei Kunikata, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/213,804

(22) Filed: Aug. 6, 2002

(65) Prior Publication Data

US 2003/0037908 A1 Feb. 27, 2003

(30) Foreign Application Priority Data

Aug. 7, 2001 (JP) ..... 2001-238962
Feb. 5, 2002 (JP) ..... 2002-028614
Jun. 14, 2002 (JP) ..... 2002-174340

(51) Int. Cl.[7] ..... F28D 15/00

(52) U.S. Cl. ..... 165/104.21; 165/104.33; 165/80.4; 361/699; 361/700; 174/15.2; 257/714; 257/716

(58) Field of Search ..... 165/104.21, 104.33, 165/80.4; 361/699, 700; 174/15.2; 257/714, 715, 716

(56) References Cited

U.S. PATENT DOCUMENTS 3,850,234 A * 11/1974 Fowler ..... 165/153
4,002,201 A * 1/1977 Donaldson ..... 165/140
4,494,171 A * 1/1985 Bland et al. ..... 361/704
5,406,807 A * 4/1995 Ashiwake et al. ..... 62/376
5,423,376 A * 6/1995 Julien et al. ..... 165/80.4
5,429,183 A * 7/1995 Hisamori et al. ..... 165/134.1
5,435,381 A * 7/1995 Downing et al. ..... 165/110
6,257,324 B1 * 7/2001 Osakabe et al. ..... 165/104.33
6,345,665 B1 * 2/2002 Schulz-Harder ..... 165/80.4
6,397,618 B1 * 6/2002 Chu et al. ..... 62/259.2
2002/0166655 A1 * 11/2002 Sugito et al. ..... 165/104.21

FOREIGN PATENT DOCUMENTS

JP 6-265284 9/1994
JP 10-308486 11/1998

* cited by examiner

*Primary Examiner*—Terrell McKinnon
(74) *Attorney, Agent, or Firm*—Harness, Dickey & Pierce, PLC

(57) ABSTRACT

A cooling apparatus 1 boiling and condensing refrigerant is constructed to have a stacked construction by stacking a plurality of pressed members 3 and comprises a refrigerant tank portion, a heat exchanging portion and a refrigerant diffusing portion. First openings for passing refrigerant and second openings for passing cooling water are formed in the pressed members 3 used for the heat exchanging portion and the first openings communicate with internal spaces formed in the refrigerant tank portion and the refrigerant diffusing portion. According to the construction, as the cooling apparatus has the stacked construction, tubes and fins that constitute a conventional heat dissipating portion can be eliminated.

16 Claims, 28 Drawing Sheets

COOLING APPARATUS

BACKGROUND OF THE INVENTION

1. Field of the Invention

The present invention relates to a cooling apparatus for cooling a refrigerant, that boils when receiving heat from a heat generating element, through heat exchange between the boiling refrigerant and a cooling medium.

2. Description of the Related Art

For example, a cooling apparatus boiling and condensing refrigerant is known for cooling an inverter which conducts a large amount of electric current for operating a vehicle. This cooling apparatus contains a refrigerant container for storing therein liquid refrigerant and a heat dissipating portion for cooling the refrigerant, that boils when receiving heat generated by a heat generating element mounted on the refrigerant container, through heat exchange between the boiling refrigerant and a cooling medium (for example, cooling air or cooling water).

Heat generated from the heat generating element is transferred to the heat dissipating portion from the refrigerant container when the refrigerant boils or vaporizes and is emitted to the cooling medium as latent heat when the refrigerant is cooled to condense at the heat dissipating portion.

In many conventional cooling apparatuses, however, the heat dissipating portion contains tubes and fins and is fabricated by inserting the tubes in the refrigerant container. In this construction, the dimensional accuracy needs to be strictly controlled, for the tubes and holes in the refrigerant container into which the tubes are inserted, in order to prevent the leakage of the refrigerant, this causing a problem that the production of the components becomes difficult.

In addition, as a construction needs to be provided on the refrigerant container for controlling the insertion amount of the tubes, a volume occupied by the refrigerant container becomes large for the height of the cooling apparatus. As a result, as the volume of the heat dissipating portion becomes small, this causes a problem that the cooling capability becomes insufficient.

SUMMARY OF THE INVENTION

The invention was made in view of the above situation and an object thereof is to provide a cooling apparatus boiling and condensing refrigerant which can facilitate the production of the components involved and reduce the volume that is to be occupied by a refrigerant encapsulating portion (a refrigerant tank portion) so as to expand a heat dissipating surface area of the cooling apparatus.

According to an aspect of the invention, there is provided a cooling apparatus boiling and condensing refrigerant having a refrigerant tank portion having a heat generating element mounted on a surface thereof and adapted to store therein a refrigerant, and a heat exchanging portion for executing heat exchange between the refrigerant that boils by being heated by heat generated by the heat generating element and a cooling medium, and constructed, as a whole, by stacking a number of plate-like members, wherein first openings that form part of the refrigerant passages and second openings that form part of the cooling passages are provided in the plurality of plate-like members which are used for the heat exchanging portion, the first opening portions being adapted to establish a communication with an internal space of the refrigerant tank portion.

According to the construction, as the cooling apparatus including the refrigerant tank portion and the heat exchanging portion has a stacked construction as a whole, tubes and fins, which are used to constitute the conventional heat dissipating portion, can be eliminated. As a result, as there exists no tube needing to be assembled to be inserted into the refrigerant tank portion, no strict dimension control of component parts is required and therefore the production of component parts is facilitated. In addition, as the adoption of the stacked construction allows the component parts to be assembled from one direction, automation of the assembling process can be easily arranged.

Furthermore, as the elimination of the conventional component parts obviates the necessity of providing the construction for controlling the inserting amount of the tubes into the refrigerant tank portion on the same refrigerant tank portion, the volume of the refrigerant tank portion which occupies part of the overall volume of the cooling apparatus can be reduced. As a result, the heat dissipating surface area of the cooling apparatus can be expanded to thereby improve the heat dissipating performance thereof.

According to another aspect of the invention, there is provided a cooling apparatus boiling and condensing refrigerant having a refrigerant tank portion having a heat generating element mounted on a surface thereof and adapted to store therein a refrigerant, a refrigerant diffusing portion for diffusing the refrigerant that boils by being warmed by heat generated by the heat generating element and a heat exchanging portion provided between the refrigerant tank portion and the refrigerant diffusing portion for executing heat exchange between the boiling refrigerant and a cooling medium, and constructed, as a whole, by stacking a number of plate-like members, wherein first openings that form part of refrigerant passages and second openings that form part of cooling passages are provided in those of the plurality of plate-like members which are used for the heat exchanging portion, the first opening portions being adapted to establish communications with internal spaces of the refrigerant tank portion and the refrigerant diffusing portion.

According to the construction, as the cooling apparatus including the refrigerant tank portion, as well as the heat exchanging portion and the refrigerant diffusing portion has a stacked construction as a whole, tubes and fins, which are used to constitute the conventional heat dissipating portion, can be eliminated. As a result, as there exists no tube needing to be assembled to be inserted into the refrigerant tank portion, no strict dimensional control of component parts is required and therefore the production of component parts is facilitated. In addition, as the adoption of the stacked construction allows the component parts to be assembled from one direction, the automation of the assembling process can be easily arranged.

Furthermore, since the elimination of the conventional tubes obviates the necessity of providing the construction for controlling the inserting amount of the tubes into the refrigerant tank portion on the same refrigerant tank portion, the volume of the refrigerant tank portion which occupies part of the overall volume of the cooling apparatus can be reduced. As a result, the heat dissipating surface area of the cooling apparatus can be expanded to thereby improve the heat dissipating performance thereof.

In the cooling apparatus according to the invention, two different types of plate-like members, which are different from each other in at least the location of the second openings, are used for the heat exchanging portion, the two types of plate-like members being stacked alternately so that the second openings thereof partly communicate with each other.

According to the construction, the second openings provided in the two types of plate-like members partly communicate with each other to thereby form the cooling passages through which the cooling medium is allowed to flow.

In the cooling apparatus according to the invention, the two types of plate-like members each have pillar portions which divide the respective second openings, the locations of the pillar portions being different from each other between the two types of plate-like members.

According to the construction, as the plate-like portions have the pillar portions, the strength of the plate-like portions can be ensured. In addition, as the locations of the pillar portions are different from each other between the two types of plate-like portions, winding cooling passages, not linear cooling passages, extending around the pillar portions, can be formed.

In the cooling apparatus according to the invention, inner fins are inserted in the refrigerant passages and the cooling passages or either of them for increasing the heat conducting surface area.

According to the construction, the heat exchange between the refrigerant and the cooling medium can be promoted to thereby increase the cooling performance of the cooling apparatus.

In the cooling apparatus according to the invention, the inner fins are each formed into a configuration having an elasticity.

As this occurs, in inserting the inner fins into the refrigerant passages or the cooling passages, as the fins can be inserted while being compressed, there is no risk that the fins are hooked at intermediate positions along the length of the passages and therefore the fins can be inserted into the passages easily and securely. In addition, after having been so inserted into the passages, the inner fins can be joined to inner wall surfaces of the passages by utilizing the elasticity thereof, and therefore, joining failures of the inner fins can be advantageously reduced.

In the cooling apparatus according to the invention, the internal capacity of the refrigerant tank portion is set larger than a sum of an internal capacity formed by the first openings of the entirety of the heat exchanging portion and the internal capacity of the refrigerant diffusing portion.

According to the construction, even when the cooling apparatus is put in an inclined posture, there is no risk that part of the boiling surface dries out (dry-out), whereby a deterioration in performance when tilted can be prevented.

In the cooling apparatus according to the invention, the first openings provided in the heat exchanging portion are each constituted by a group of opening holes in which a plurality of opening holes, that are each opened in a circular or rectangular configuration, are formed in a continuous fashion.

According to the construction, the number of pillar portions formed between the opening holes can be increased and, as this can help attempt to increase the condensing surface area, the construction can contribute to the improvement in cooling performance. In addition, as the internal capacity formed by the first openings in the heat exchanging portion on the refrigerant side is reduced, the deterioration in cooling performance of the cooling apparatus, when it is used while being in a tilted posture, can advantageously be suppressed.

In the cooling apparatus according to the invention, tank portions are provided on the plate-like members used for the heat exchanging portion at ends of the second openings, and heat exchanging areas are provided on the plate-like members constituting the refrigerant tank portion and the refrigerant diffusing portion for executing heat exchange between the cooling medium that flows through the tank portions and the refrigerant.

According to the construction, as the heat exchanging areas for executing heat exchange between the refrigerant and the cooling medium are increased, an improvement in performance can be expected. Further, as heat exchanging areas are provided, the internal capacity of the refrigerant side can be increased, and when the cooling apparatus is used while being in a tilted posture, the deterioration in cooling performance thereof can be suppressed.

In the cooling apparatus according to the invention, the heat generating element is mounted at a substantially central portion of the surface of the refrigerant tank portion, and the internal capacity of a portion of the refrigerant tank portion, which belongs to an area thereof which is excluded from an area thereof where the heat generating element is mounted, is set larger than the internal capacity of a portion of the refrigerant tank portion which belongs to the area thereof where the heat generating element is mounted.

According to the construction, as the internal capacity of the portion of the refrigerant tank portion, which belongs to the area of the same tank portion which is excluded from the area thereof where the heat generating element is mounted, can be set larger even when the cooling apparatus is used while being in the tilted posture, there is no risk that the vaporizing surface dries out partially (dry-out), thereby making it possible to prevent the deterioration in cooling performance while the cooling apparatus is being tilted.

According to a further aspect of the invention, there is provided a cooling apparatus boiling and condensing refrigerant having a refrigerant tank portion having a heat generating element mounted on a surface thereof and adapted to store therein a refrigerant, and a heat exchanging portion for executing heat exchange between the refrigerant, that boils by being warmed by heat generated by the heat generating element, and a cooling medium, and constructed, as a whole, by stacking a number of plate-like members, wherein the heat exchanging portion is constructed by alternately stacking the first plate-like members having first openings, that form part of refrigerant passages to communicate with an internal space in the refrigerant tank portion, and second openings, that form part of cooling passages, and the second plate-like members having at least the first openings, the second plate-like member being set to be thinner than the first plate-like member so as to have a function as a fin.

According to the construction, as the cooling apparatus including the refrigerant tank portion and the heat exchanging portion has a stacked construction as a whole, tubes and fins, which are used to constitute the conventional heat dissipating portion, can be eliminated. As a result, as there exists no tube needing to be assembled to be inserted into the refrigerant tank portion, no strict dimensional control of component parts is required and therefore the production of component parts is facilitated. In addition, as the adoption of the stacked construction allows the component parts to be assembled from one direction, the automation of the assembling process can be easily arranged.

Furthermore, as the elimination of the conventional tubes obviates the necessity of providing the construction for controlling the inserting amount of the tubes into the refrigerant tank portion on the same refrigerant tank portion, the volume of the refrigerant tank portion which occupies part of the overall volume of the cooling apparatus can be reduced. As a result, the heat dissipating surface area of the cooling apparatus can be expanded to thereby improve the heat dissipating performance thereof.

In addition, as both upper and lower surfaces of the second opening formed in the first plate-like member are closed with the thinner second plate-like members, the second plate-like members can play the role of a fin relative to the cooling medium, whereby the heat conducting surface area on the cooling medium side can be increased to thereby improve the cooling performance.

According to another aspect of the invention, there is provided a cooling apparatus boiling and condensing refrigerant having a refrigerant tank portion having a heat generating element mounted on a surface thereof and adapted to store therein a refrigerant, a refrigerant diffusing portion for diffusing the refrigerant that boils by being warmed by heat generated by the heat generating element, and a heat exchanging portion provided between the refrigerant tank portion and the refrigerant diffusing portion for executing heat exchange between the boiling refrigerant and a cooling medium and constructed, as a whole, by stacking a number of plate-like members, wherein the heat exchanging portion is constructed by alternately stacking the first plate-like members having first openings, that form part of refrigerant passages to communicate with internal spaces in the refrigerant tank portion and the refrigerant diffusing portion, and second openings, that form part of cooling passages, and the second plate-like members having at least the first openings, the second plate-like member being set to be thinner than the first plate-like member so as to have a function as a fin.

According to the construction, as the cooling apparatus including the refrigerant tank portion and the heat exchanging portion, as well as the refrigerant diffusing portion, has a stacked construction as a whole, tubes and fins can be eliminated which are used to constitute the conventional heat dissipating portion. As a result, as there exists no tube needing to be assembled to be inserted into the refrigerant tank portion, no strict dimensional control of component parts is required and therefore the production of component parts is facilitated. In addition, as the adoption of the stacked construction allows the component parts to be assembled from one direction, the automation of the assembling process can be easily arranged.

Furthermore, as the elimination of the conventional tubes obviates the necessity of providing the construction for controlling the inserting amount of the tubes into the refrigerant tank portion on the same refrigerant tank portion, the volume of the refrigerant tank portion, which occupies part of the overall volume of the cooling apparatus, can be reduced. As a result, the heat dissipating surface area of the cooling apparatus can be expanded to thereby improve the heat dissipating performance thereof.

In the cooling apparatus according to the invention, the second plate-like member has a communication port which communicates with the second opening formed in the first plate-like member.

According to the construction, since the cooling medium is allowed not only to flow through the second opening in parallel with the first plate-like member but also to pass through the communication port formed in the second plate-like member so as to flow through the heat exchanging portion in a direction in which the plate-like members are stacked, the cooling performance can be increased.

In the cooling apparatus according to the invention, the second opening in the first plate-like member is provided in such a manner as to be divided into a second opening portion and another second opening portion with a pillar portion being left therebetween, and the communication port formed in the second plate-like member is adapted to communicate with both the second opening portion and the other second opening portion.

According to the construction, as the second opening (the second opening portion and the other second opening portion) is formed in the first plate-like member with the pillar portion being left therebetween, the strength of the first plate-like member is increased. In addition, as the communication port formed in the second plate-like member communicates with both one second opening portion and another second opening portion, cooling water is allowed to flow in a winding fashion by flowing around the pillar portions.

In the cooling apparatus according to the invention, a sacrificial material is affixed to one or both sides of at least either of the first plate-like member and the second plate-like member which are both made of a metal.

According to the construction, the affixation of the sacrificial material to the plate-like member can restrain the corrosion of the plate-like member by the cooling medium, the leakage of gas hermetically sealed therein thereby being prevented.

In addition, the sacrificial material is a metallic material having a lower corrosion resistance against the cooling medium than that of the plate-like members and, for example, in the event that the plate-like member is made of aluminum, the sacrificial member can be an aluminum material containing Zn (zinc).

In the cooling apparatus according to the invention, the second-plate like member has a plurality of cut and erected pieces which are provided in such a manner as to be cut and erected from the surface thereof, and these cut and erected pieces protrude into the second opening formed in the first plate-like member.

According to the construction, as the cut and erected pieces are provided in such a manner as to protrude into the second opening through which the cooling medium flows, vertical vortexes can be induced in the cooling medium so as to promote heat conduction (turbulent flows).

In the cooling apparatus according to the invention, the second plate-like member is provided such that the surface of the second plate-like member becomes irregular within the second opening formed in the first plate-like member.

According to the construction, as the cooling medium flows along the irregular configuration in the vicinity of the surface of the second plate-like member, vertical vortexes can be induced in the cooling medium to promote heat conduction (turbulent flows).

In the cooling apparatus according to the invention, the first openings formed in the plurality of plate-like members that are used for the heat exchanging portion are adapted to communicate with one another to form refrigerant passages that communicate with the refrigerant tank portion, and barrier wall portions are provided in the refrigerant passages for disturbing the flow of the refrigerant.

As the refrigerant tank portion and the heat exchanging portion of the cooling apparatus according to the invention are adjacent to each other in the direction in which the plate-like members are stacked, when the thermal load from the heat generating element becomes large, there may occur a case where the liquid refrigerant boils up into the heat exchanging portion which should normally be filled with vaporized refrigerant. As this occurs, and in the event that the liquid refrigerant penetrates into the heat exchanging portion, the actual condensing surface area of the heat exchanging portion is reduced, this reducing, in turn, the cooling performance of the cooling apparatus. The boiling up of liquid refrigerant can be prevented by providing barrier wall portions (for example, a labyrinth construction) within the refrigerant passages which establish a communicate between the refrigerant tank portion and the heat exchanging portion, whereby the deterioration in cooling performance can be suppressed.

In the cooling apparatus according to the invention, the cooling medium is liquid such as water.

In the case of utilizing water as the cooling medium, heat dissipating fins that are used in a cooling apparatus utilizing air as the cooling medium can be eliminated by adopting the stacked construction in which the plurality of plate-like members are stacked as a cooling apparatus.

The present invention may be more fully understood from the description of preferred embodiment of the invention, as set forth below, together with the accompanying drawings.

DESCRIPTION OF THE PREFERRED EMBODIMENTS

Next, embodiments of the invention will be described based on the accompanying drawings.

(First Embodiment)

Figure 1:
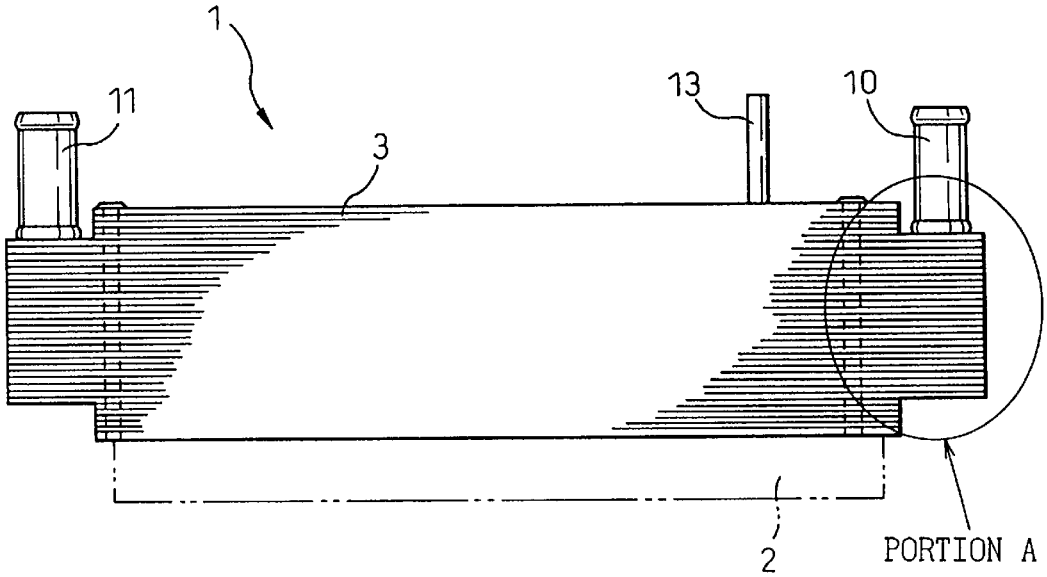
FIG. 1 is an overall side view of a cooling apparatus according to the invention.
Figure 2:
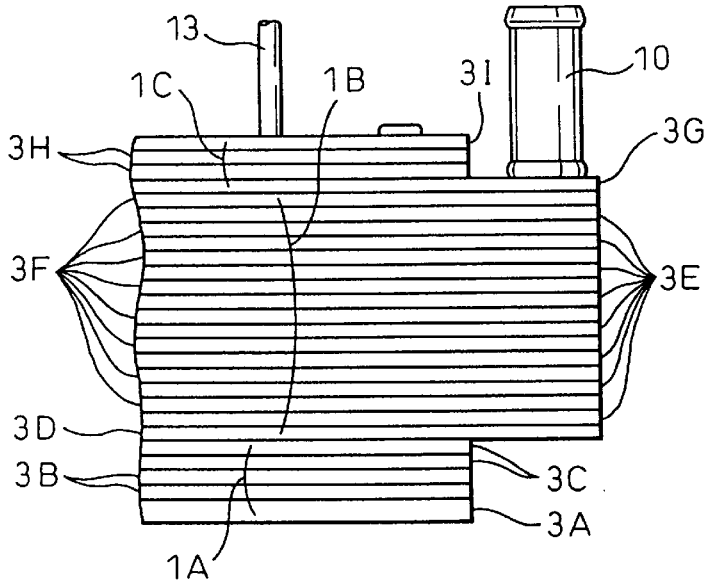
FIG. 2 is an enlarged view of a portion A in FIG. 1.
Figure 3:
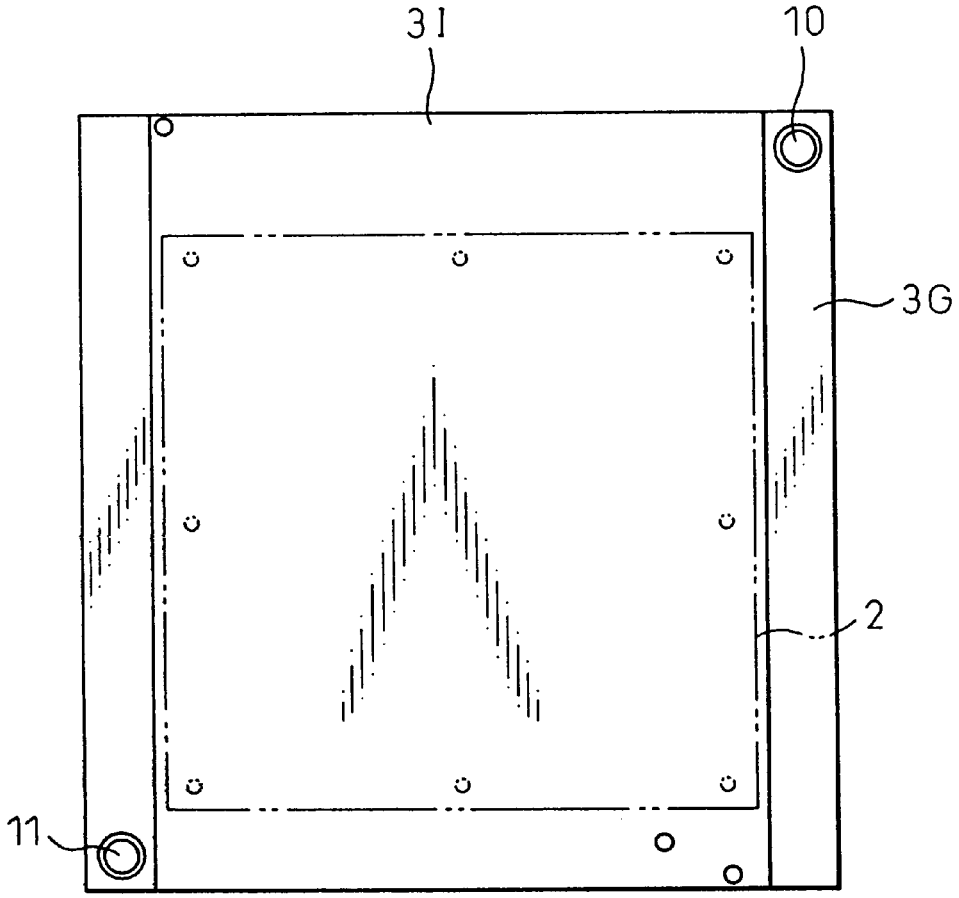
FIG. 3 is a top plan view of the cooling apparatus according to the invention.

FIG. 1 is an overall side view of a cooling apparatus 1, FIG. 2 is an enlarged view of a portion A in FIG. 1, and FIG. 3 is a top plan view of the cooling apparatus.

The cooling apparatus 1 boiling and condensing refrigerant according the first embodiment has provided therein a refrigerant tank portion 1A for storing therein a refrigerant, a heat exchanging portion 1B for executing heat exchange between the refrigerant, that boils by being heated by heat generated from a heat generating element 2 in the refrigerant tank portion 1A, and a cooling medium, and a refrigerant diffusing portion 1C for diffusing the vaporized refrigerant flowing thereinto from the refrigerant tank portion 1A via the heat exchanging portion 1B (refer to FIG. 2 for those constituent portions that have been just described), and, as shown in FIG. 1, has a stacked construction formed by stacking a plurality of pressed members (plate-like members of the invention).

The heat generating element 2 is, for example, an IGBT (insulated gate bipolar transistor) element for use in an inverter for driving an electric vehicle, and is fixed to the surface of the refrigerant tank portion 1A with screws (refer to FIG. 1).

The pressed members 3 are press formed of sheet metal of aluminum that has a superior heat conductivity and a layer of a wax material is provided in advance on the surface of a side of the sheet metal.

The pressed members 3 are constituted by two outer pressed members 3A, 3I which are placed on, respectively, outermost sides of the pressed members 3 in a direction in which the pressed members are stacked and a plurality of intermediate pressed members 3B to 3H which are stacked between the two outer pressed members 3A, 3I, and openings (which will be described later) are formed in the intermediate pressed members 3B to 3H in such a manner as to penetrate through the pressed members in a thickness direction, the openings having predetermined opening patterns for the refrigerant tank portion 1A, the heat exchanging portion 1B and the refrigerant diffusing portion, respectively.

Figure 4:
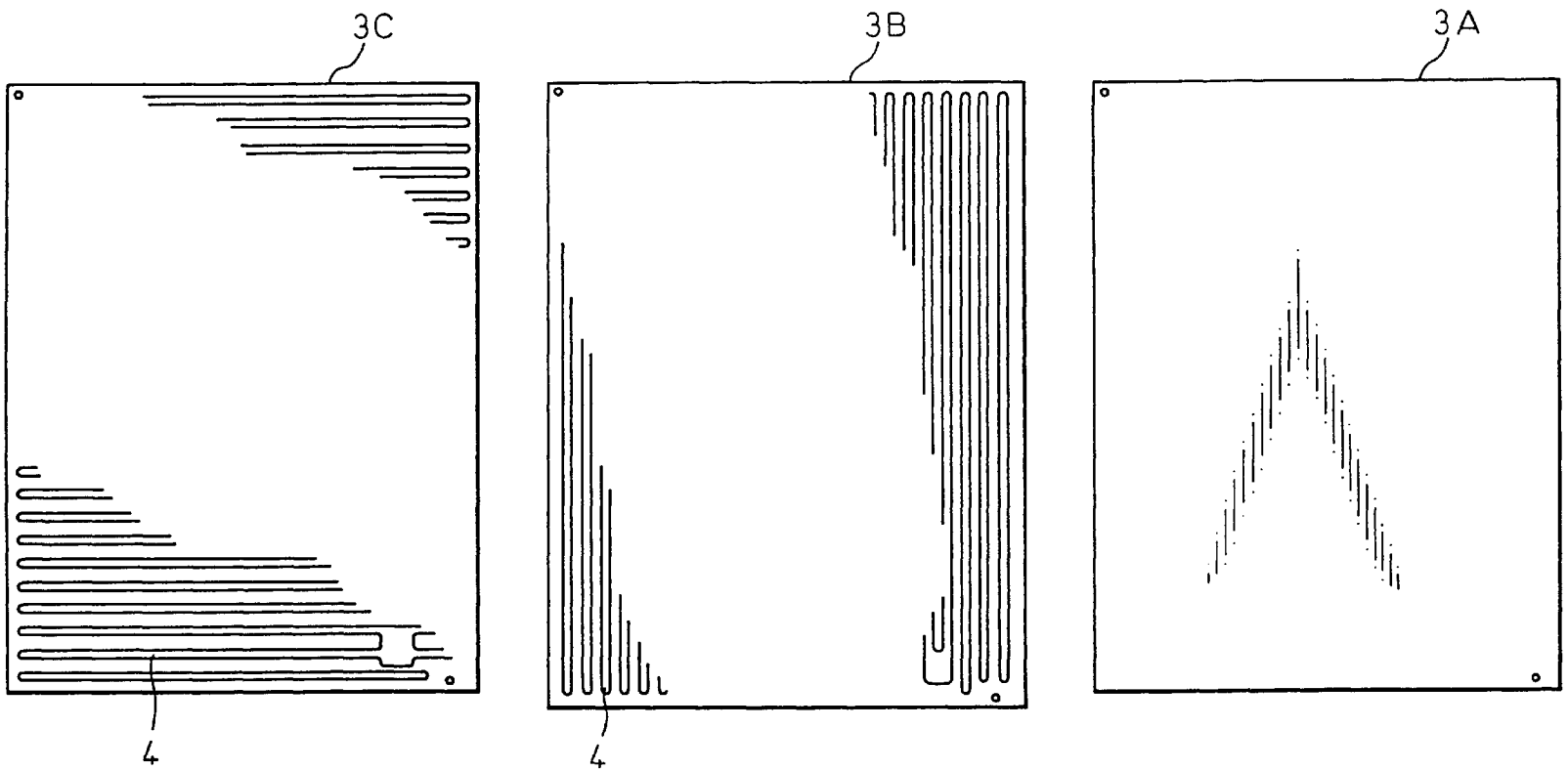
FIG. 4 shows plan views of pressed members for use for a refrigerant tank portion of the cooling apparatus according to the invention.
Figure 5:
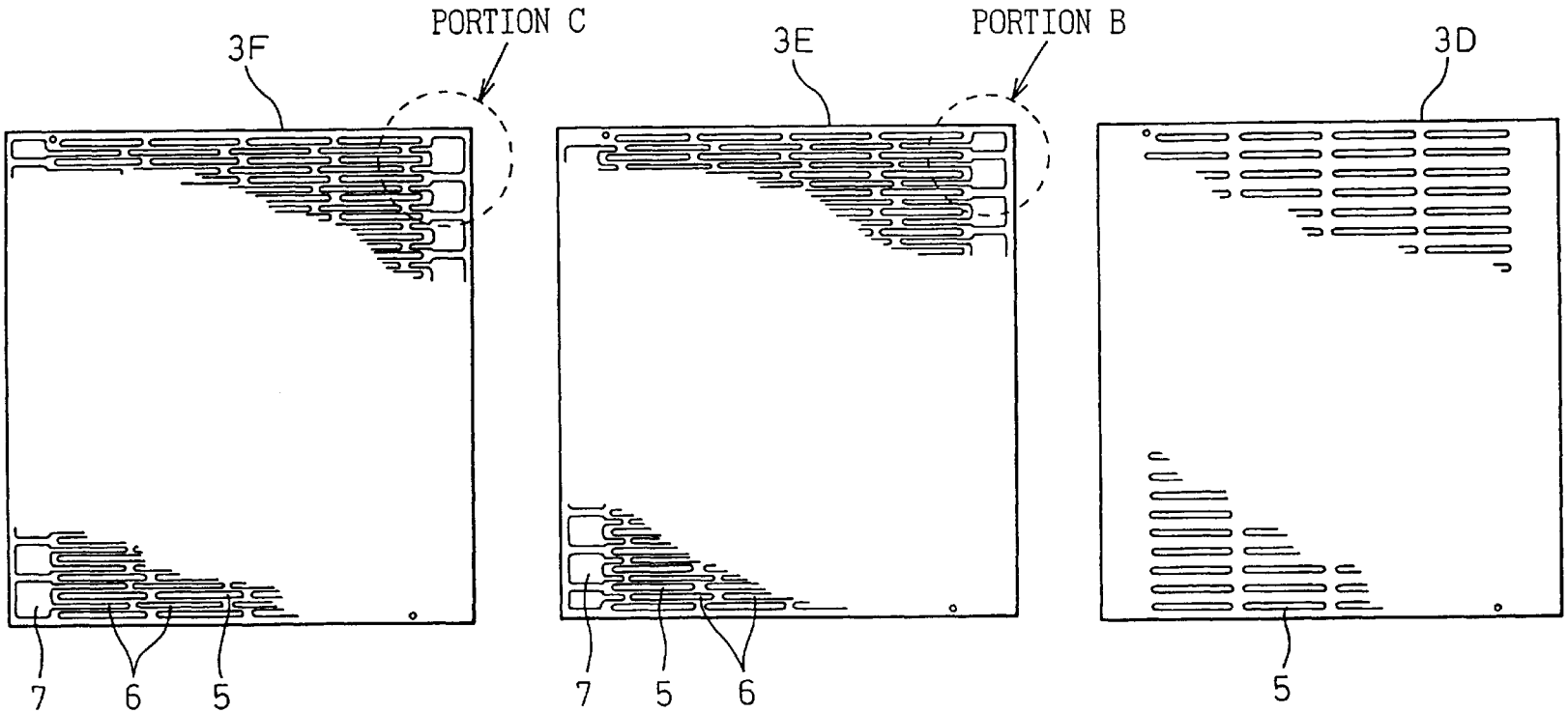
FIG. 5 shows plan views of pressed members for use for a heat exchanging portion of the cooling apparatus according to the invention.
Figure 6:
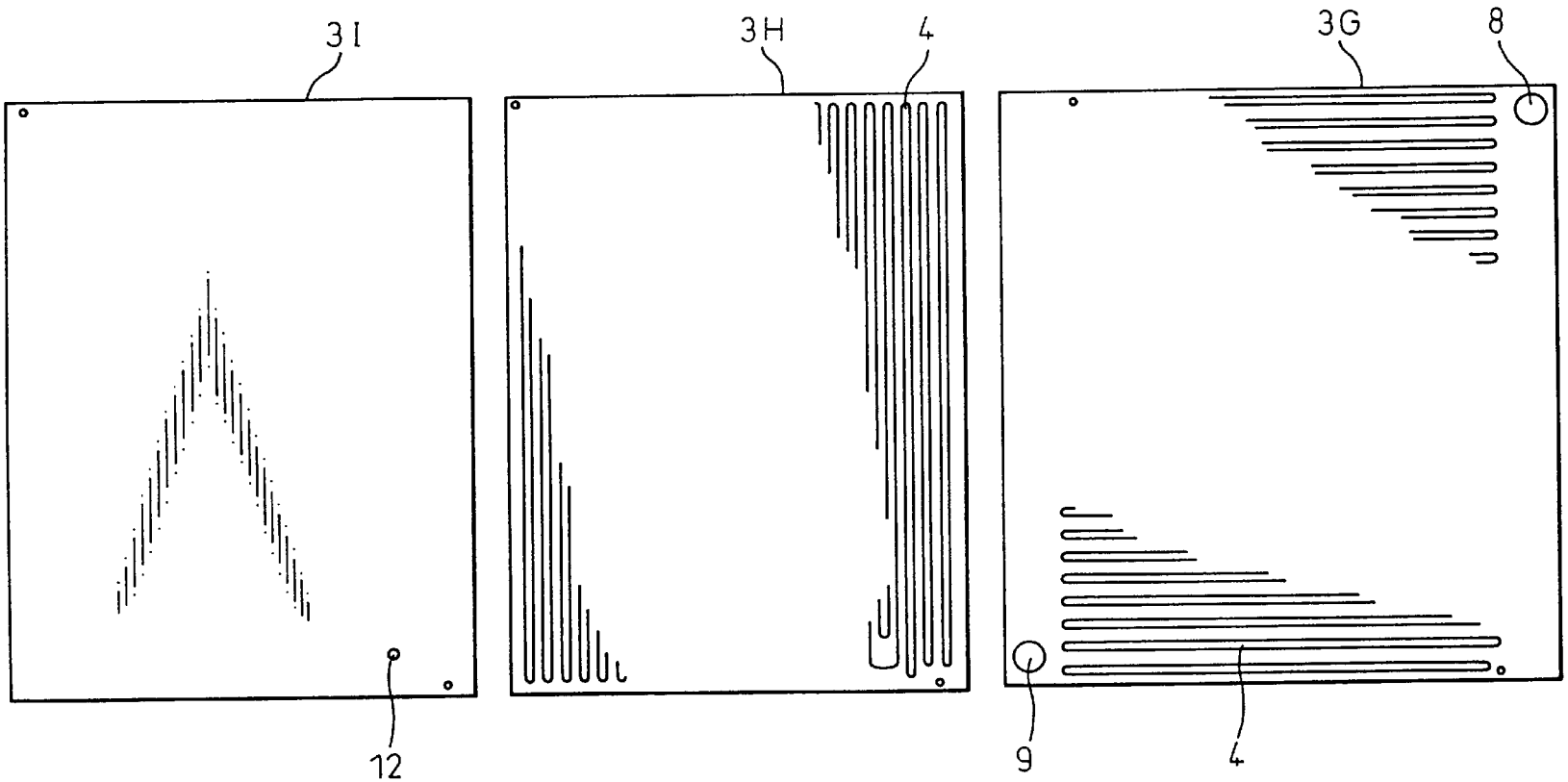
FIG. 6 shows plan views of pressed members for use for a refrigerant diffusing portion of the cooling apparatus according to the invention.

An example of the pressed members 3 (3A to 3I) are shown in FIGS. 4 to 6.

FIG. 4 shows an outer pressed member 3A and two types of intermediate pressed members 3B, 3C which are all used for the refrigerant tank portion 1A.

The outer pressed member 3A is formed thicker than the other pressed members 3B to 3I in order to secure the flatness of a mounting surface thereof as the heat generating element 2 is mounted on the mounting surface (refer to FIG. 2).

A plurality of slit-like openings 4 are formed in the intermediate pressed members 3B, 3C substantially all over the surfaces of the members, and the openings 4 of the both intermediate pressed members 3B, 3C communicate with each other to form an internal space in the refrigerant tank portion 1A. These two types of pressed members 3B, 3C are constructed so as to have an opening pattern in which the openings 4 are formed in a longitudinal direction (the intermediate pressed member 3B) and another opening pattern in which the openings 4 are formed in a transverse direction (the intermediate pressed member 3C), respectively, so that refrigerant can flow through the refrigerant tank portion 1A in both the longitudinal and transverse directions when they are assembled together.

FIG. 5 shows three types of intermediate pressed members 3D, 3E, 3F which are used for the heat exchanging portion 1B.

Only a number of first elongated hole-like openings 5 are formed in the intermediate pressed member 3D substantially all over the surface thereof for passing refrigerant therethrough.

Formed in the intermediate pressed members 3E, 3F are second elongated hole-like openings 6 for passing cooling water therethrough and communicating portions 7 (refer to FIGS. 7 and 8) which communicate with the second openings 6 as well as first openings 5.

The first openings 5 in the intermediate pressed members 3E, 3F are formed in the same positions as those of the first openings 5 formed in the intermediate pressed member 3D, so that the first openings 5 in the respective three types of intermediate pressed members 3D to 3F communicate with one another in the stacked direction to thereby form a refrigerant passage.

On the other hand, the second openings 6 are formed in the intermediate pressed members 3E, 3F in the longitudinal direction (a vertical direction in FIG. 5) thereof alternately with the first openings 5. However, while the positions of the second openings 6 formed in intermediate pressed member 3E and the positions of the second openings formed in the intermediate pressed member 3F coincide with each other in the longitudinal direction, the positions of the second openings 6 in those intermediate pressed members are offset in the transverse direction (a transverse direction in FIG. 5) by in the order of half the length of the second opening 6.

Figure 7:
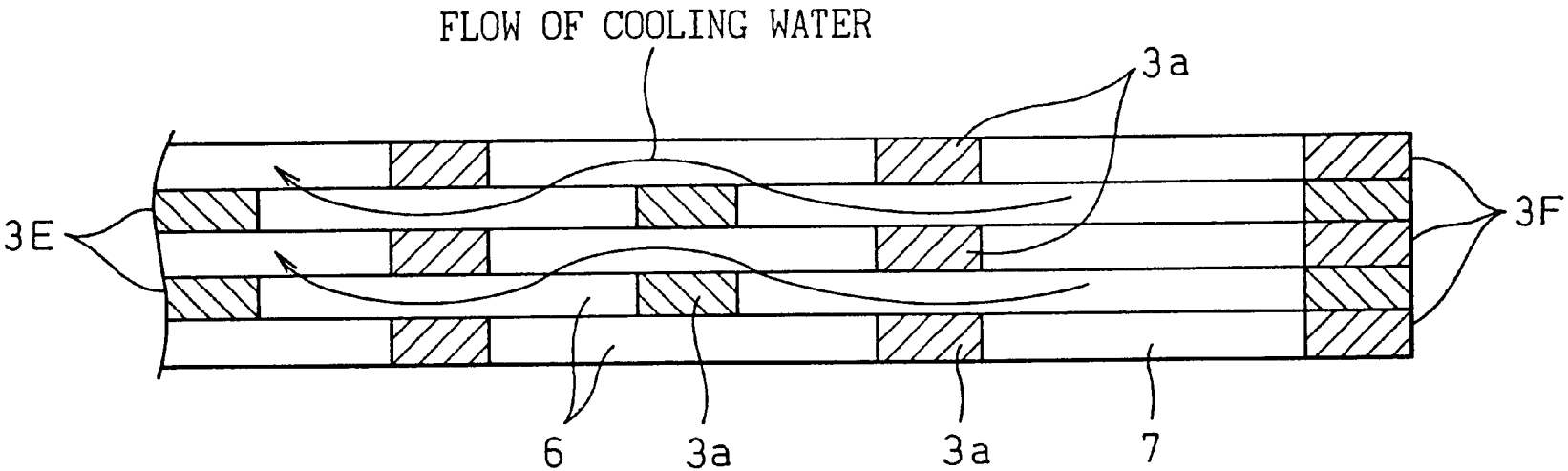
FIG. 7 is a sectional view of the heat exchanging portion showing the flow of cooling water taken along line D—D in FIG. 8.

Consequently, when the two types of intermediate pressed members 3E, 3F are stacked alternately, as shown in FIG. 7, the positions of pillar portions 3*a* which divide the second openings 6 in both the intermediate pressed members 3E, 3F become discontinuous in the stacked direction (a vertical direction in FIG. 7) and offset in the transverse direction, whereby the second openings 6 in both the intermediate pressed members 3E, 3F come to communicate with each other in an alternate fashion, cooling water passages being thereby formed which extend in a winding (meandering) fashion in the transverse direction of the intermediate pressed portion 3E, 3F.

Figure 8:
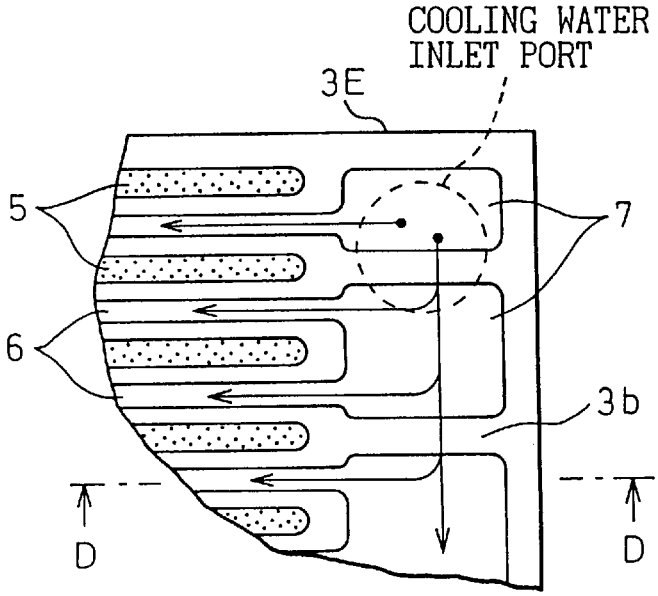
FIG. 8 is an enlarged view of a portion B in FIG. 5.
Figure 9:
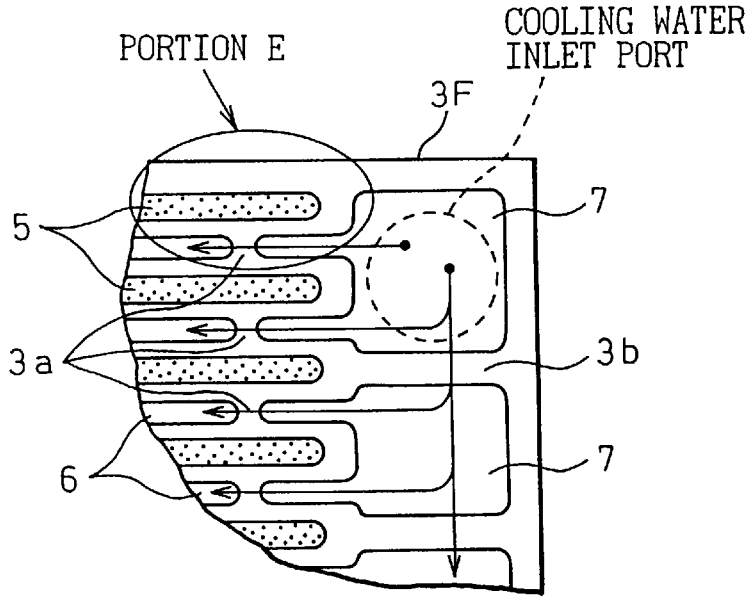
FIG. 9 is an enlarged view of a portion C in FIG. 5.

As shown in FIGS. 8 and 9, the communicating portions 7 formed in the intermediate pressed members 3E, 3F are divided into a plurality of portions with pillar portions 3*b* being left in the longitudinal direction, and the pillar portions 3*b* formed on the intermediate pressed member 3E and the pillar portions 3*b* formed on the intermediate pressed member 3F are set at different positions, whereby when the two types of intermediate pressed members 3E, 3F are stacked on each other in an alternate fashion, the communicating portions 7 in the respective intermediate pressed members 3E, 3F come to communicate with each other in an alternate fashion, tank portions which communicate with all the cooling water passages being thereby formed.

In addition, cooling water passages (second openings 6) in the heat exchanging portion 1B are separated from the internal space (the openings 4) in the refrigerant tank portion 1A by disposing the intermediate pressed member 3D between the refrigerant tank portion 1A and the heat exchanging portion 1B (see FIG. 2).

FIG. 6 shows another two types of intermediate pressed members 3G, 3H and the other outer pressed member 3I.

The intermediate pressed members 3G, 3H basically have similar opening patterns (the openings 4) to those of the intermediate pressed members 3C, 3B which are used for the refrigerant tank portion 1A and are stacked on an upper portion of the heat exchanging portion 1B to form an internal space which communicates with refrigerant passages (the first openings 5) formed in the heat exchanging portion 1B.

In addition, the cooling water passages (the second openings 6) in the heat exchanging portion 1B are separated from an internal space (openings 4) in the refrigerant diffusing portion 1C by disposing the intermediate pressed member 3G between the heat exchanging portion 1B and the refrigerant diffusing portion 1C.

Additionally, a cooling water inlet 8 and a cooling water outlet 9 are formed in the intermediate pressed member 3G at diagonal positions in such a manner as to communicate with the tank portions (the communicating portions 7) of the heat exchanging portion 1B (refer to FIGS. 8 and 9). An inlet pipe 10 and an outlet pipe 11 are attached to the cooling water inlet 8 and the cooling water outlet 9, respectively (refer to FIG. 1).

The outer pressed member 3I is stacked on an upper side of the intermediate pressed member 3H (or 3G) to thereby close the openings 4 in the intermediate pressed member 3H (or 3G). In addition, a refrigerant filler port 12 for filling refrigerant therefrom into the cooling apparatus 1 is provided in the outer pressed member 3I. As shown in FIG. 1, a refrigerant encapsulating pipe 13 is attached to the refrigerant filler port 12, and a distal end of the refrigerant encapsulating pipe 13 is sealed off after refrigerant is filled into the cooling apparatus 1.

Next, the function of the cooling apparatus 1 boiling and condensing refrigerant will be described.

The refrigerant that boils by receiving heat from the heat generating element 2 flows from the refrigerant tank portion 1A into the refrigerant diffusing portion 1C after it has passed through the respective refrigerant passages (the first openings 5) in the heat exchanging portion 1B, and after having been diffused in the refrigerant diffusing portion 1C, the refrigerant flows again into the respective refrigerant passages in the heat exchanging portion 1B in a diffused fashion.

On the other hand, by passing the cooling water through the cooling water passages (the second openings 6) in the heat exchanging portion 1B, heat exchange is executed between the vaporized refrigerant filling the refrigerant passages and the cooling water flowing through the cooling water passages, and the refrigerant that condenses, when cooled, returns to the refrigerant tank portion 1A, whereby the heat generated from the heat generating element 2 is delivered from the refrigerant tank portion 1A to the heat exchanging portion 1B (the refrigerant passages) by virtue of the vaporization of the refrigerant and is then emitted to the cooling water as latent heat when the refrigerant condenses when it is cooled in the heat exchanging portion 1B.

(Effectiveness of First Embodiment)

As the cooling apparatus boiling and condensing refrigerant according to the invention has the stacked construction in which the entirety thereof (the refrigerant tank portion 1A, the heat exchanging portion 1B and the refrigerant diffusing portion 1C) is constructed by stacking the plurality of pressed members 3, tubes and fins, that constitute a conventional heat dissipating portion, can be eliminated. As a result, as there exists no tube that needs to be assembled to be inserted into the refrigerant tank portion 1A, no strict dimensional control of the component parts is required, and the production of the component parts can be facilitated. In addition, as the adoption of the stacked construction enables the assembly of the component parts from one direction, the automation of the assembling process can be easily arranged.

Furthermore, as the elimination of the conventional tubes obviates the necessity of provision of a construction on the refrigerant tank portion 1A for controlling the inserting amount of the tubes into the refrigerant tank portion 1A, the portion of the overall volume of the cooling apparatus 1 which is occupied by the refrigerant tank portion 1A can be reduced. As a result, the heat dissipating surface area can be increased to thereby improve the heat dissipating performance of the apparatus. In addition, as the elimination of the tubes can eliminate in turn a risk of adhesion failure of the tubes, a risk of refrigerant leakage can advantageously be prevented.

As the cooling apparatus 1 according to the invention utilizes cooling water having a large heat capacity flow rate as a cooling medium for cooling the refrigerant that boils by receiving heat from the heat generating element 2, heat dissipating fins that are used in a cooling apparatus utilizing cooling air can be eliminated to thereby reduce the number of component parts involved.

In addition, as the refrigerant passages (the first openings 5) and the cooling water passages (the second openings 6) are provided in an alternate fashion in the heat exchanging portion 1B, the heat conducting surface area between the refrigerant and the cooling water can be increased by utilizing a so-called multi-flow(multi-tube) type construction, and moreover, as the flowing resistance can also be reduced, efficient heat exchange can be implemented.

The intermediate pressed members 3E, 3F for use in the heat exchanging portion 1B has the pillar portions **3*a*, 3*b* between the second openings 6 which are contiguous with each other and between the communicating portions 7 which are contiguous with each other. The strength of the pressed members 3E, 3F can be secured by providing the pillar portions 3*a*, 3*b* in a way that has just been described, and as the pillar portions 3*a*, 3*b*** contribute to the increase in heat conducting surface area, the heat exchanging performance can advantageously be increased.

Furthermore, as the development of a temperature boundary layer can be suppressed by virtue of a front edge effect by the pillar portions **3*a*, 3*b*** or the like, an improvement in heat conductivity can be expected. In addition, similar effects (the improvement in heat conducting surface area and the improvement in heat conductivity) can be obtained by providing pillar portions on the refrigerant passage side.

(Second Embodiment)

A second embodiment is an example in which inner fins 14 are inserted in both or either of refrigerant passages and cooling water passages formed in a heat exchanging portion 1B.

Figure 10:
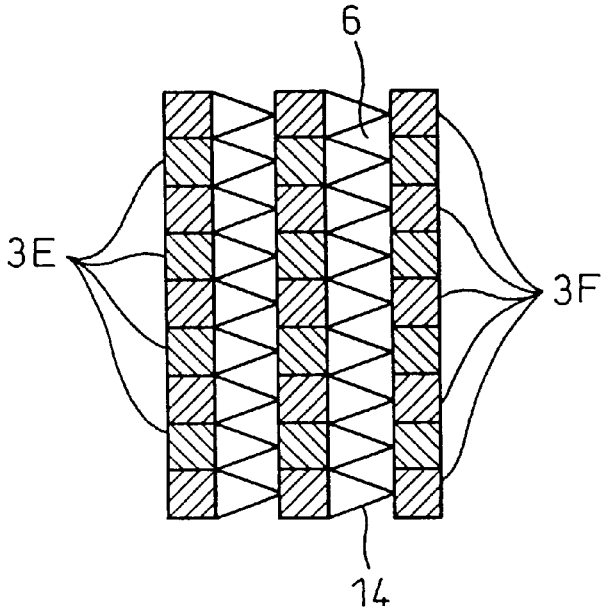
FIG. 10 is a sectional view showing inner fins that are inserted into a cooling water passages (a second embodiment)
Figure 11:
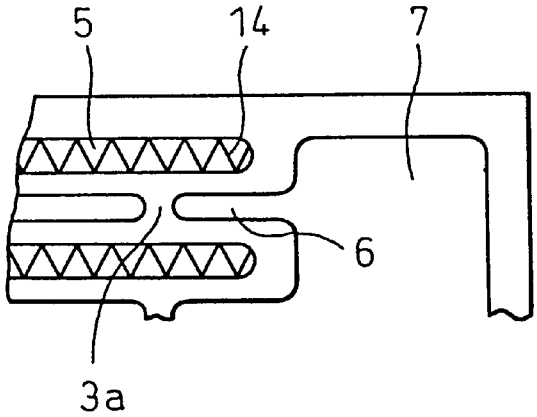
FIG. 11 is a sectional view showing inner fins that are inserted into refrigerant passages (the second embodiment)

FIG. 10 shows an example in which inner fins 14 are inserted into the cooling water passages (second openings 6), and FIG. 11 shows an example in which inner fins 14 are inserted into the refrigerant passages (first openings 5). The heat conducting surface area can be expanded with the inner fins 14 to thereby improve the cooling performance of the cooling apparatus.

Figure 12:
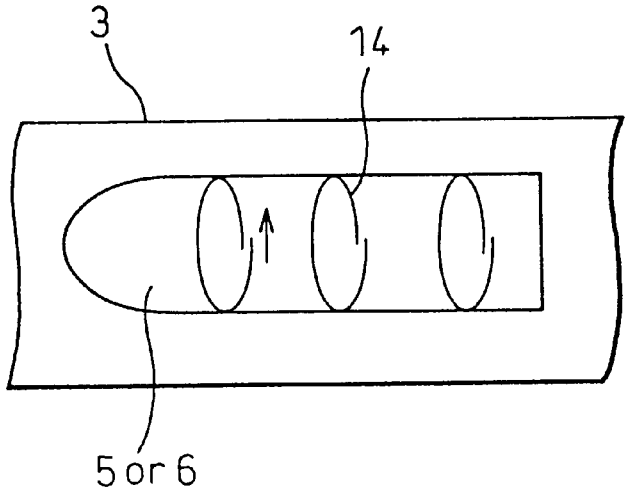
FIG. 12 is a sectional view showing an inner fin that is inserted into the passage (the second embodiment)
Figure 13:
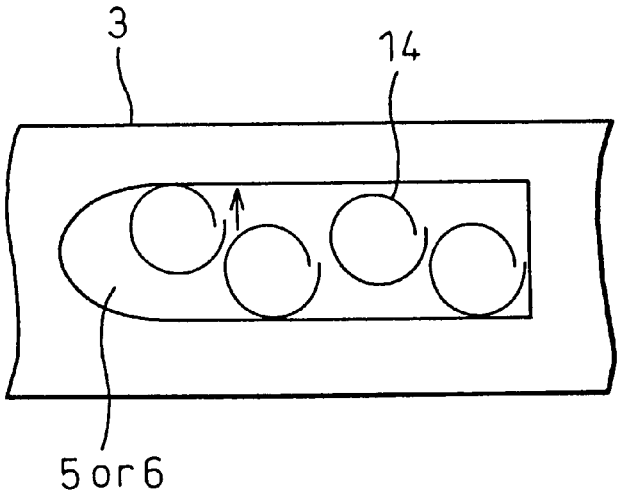
FIG. 13 is a sectional view showing an inner fin that is inserted into the passage (the second embodiment)

In addition, for example, as shown in FIGS. 12 and 13, the inner fins 14 may be formed into configurations having an elasticity. As this occurs, in inserting the inner fins 14 into the refrigerant passages or the cooling water passages, as the inner fins 14 can be inserted while being compressed, there is no risk that the inner fins 14 are hooked at intermediate positions along the length of the passages, whereby the inner fins 14 can be inserted easily and securely. In addition, as the inner fins 14 are allowed to be joined (for example, by brazing) to internal wall surfaces of the passages by utilizing the elasticity thereof after they have been inserted into the passages, the joining failure of the inner fins 14 can advantageously be improved.

(Third Embodiment)

Figure 14:
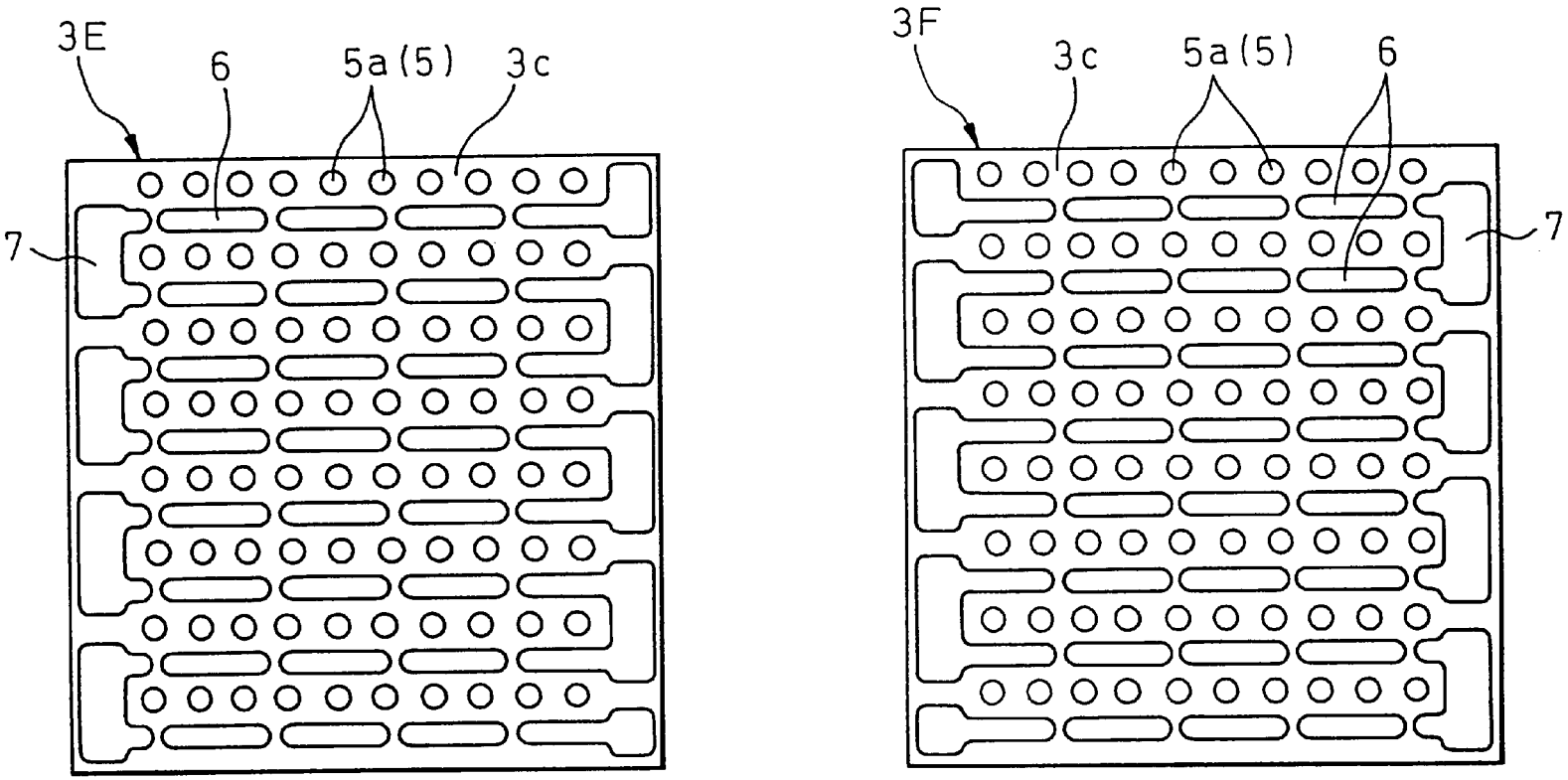
FIG. 14 shows plan views of pressed members for use in a heat exchanging portion (a third embodiment)

FIG. 14 shows plan views of pressed members 3E, 3F.

A third embodiment describes an example in which the configurations of first openings 5, which form refrigerant passages in the pressed members 3E, 3F which are used in a heat exchanging portion 1B, will be discussed.

While the first openings 5 in the first embodiment are formed into the elongated hole-like configuration (refer to FIG. 5), first openings 5 in this third embodiment will be formed into a group of opening holes which is constituted by a number of circular holes **5*a*** (alternatively, a number of rectangular holes may be used).

According to this construction, when compared with the first embodiment, as the condensing surface area of the heat exchanging portion 1B is increased due to an increase in the number of the pillar portions 3C which divide the first openings 5 into the number of circular holes 5*a*, the cooling performance can be increased.

In addition, according to the construction of the invention, there is provided an advantage that the deterioration in the cooling performance of the cooling apparatus when used in the tilted posture (for example, in the event that a vehicle having the cooling apparatus installed therein is inclined) can be suppressed.

Figure 15:
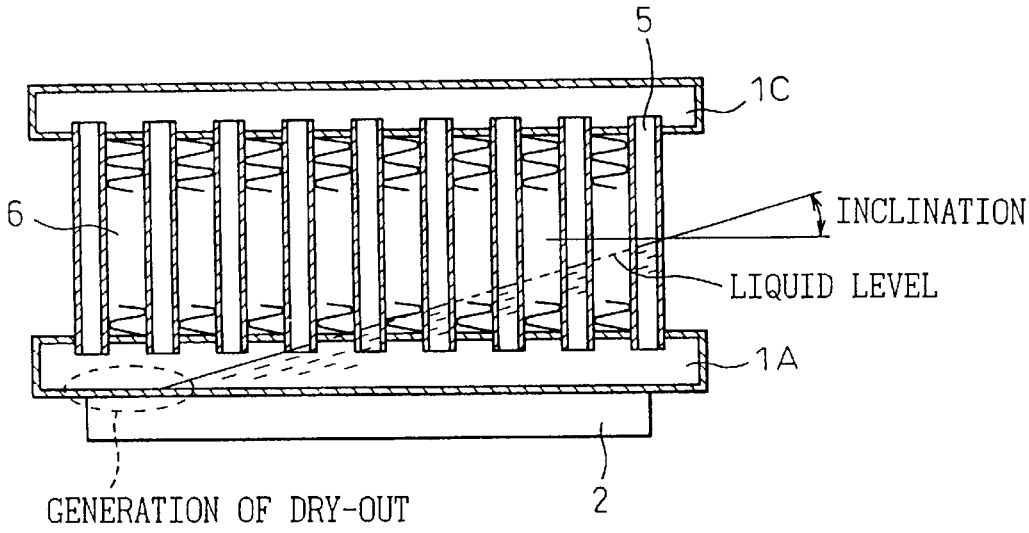
FIG. 15 is a sectional view showing typically the internal construction of a cooling apparatus (the third embodiment)
Figure 16:
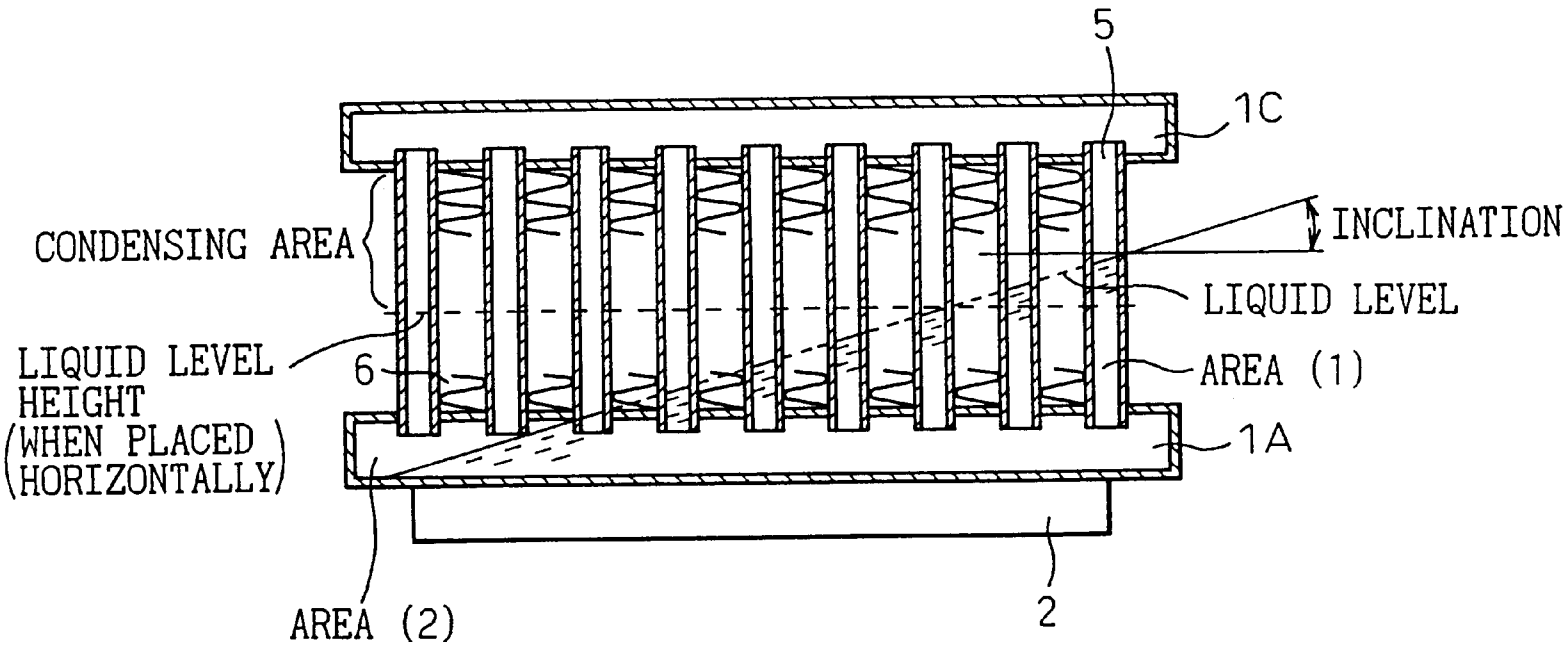
FIG. 16 is a sectional view showing typically the internal construction of the cooling apparatus (the third embodiment)

To describe specifically, the deterioration in the cooling performance of the cooling apparatus 1 is caused when part of the vaporizing surface of the refrigerant tank portion 1A is dried out (a dry-out is generated) due to the inclination of the liquid level as shown in FIG. 15. In contrast, in the event that the amount of refrigerant is increased in order to prevent the generation of dry-out as shown in FIG. 16, the level of liquid refrigerant is raised when the horizontal posture of the cooling apparatus 1 is restored, whereby the areas for condensing the refrigerant are reduced, and as a result, the cooling performance of the cooling apparatus 1 is deteriorated.

Then, when attempting to devise a construction for securing the required cooling performance in both cases where the apparatus is placed horizontally and is tilted, it can easily be assumed that the problem can be solved by either decreasing an area (1) (the internal capacity of a portion of the heat exchanging portion 1B which is under the liquid level when the cooling apparatus is tilted) or increasing an area (2) (the internal capacity of a portion of the refrigerant tank portion 1A which is above the liquid level when the apparatus is tilted). Namely, in a case where the pressed members 3E, 3F of the embodiment of the invention, when compared with the case where the pressed members 3E, 3F described with reference to the first embodiment are used (refer to FIG. 5), the pillar portions 3*c* are increased, whereby the internal capacity of the portion of the heat exchanging portion 1B which is situated on the refrigerant side can be decreased to thereby suppress the deterioration in cooling performance.

(Fourth Embodiment)

Figure 17:
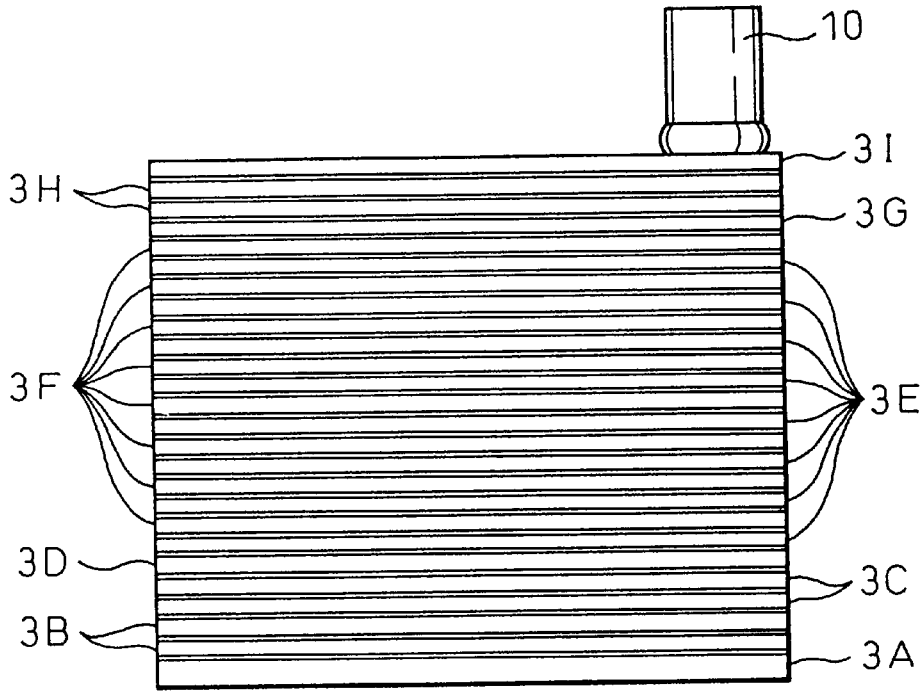
FIG. 17 is an enlarged view showing an end portion of a cooling apparatus (a fourth embodiment)

FIG. 17 is an enlarged view showing an end portion of a cooling apparatus 1 boiling and condensing refrigerant.

The cooling apparatus 1 according to a fourth embodiment of the invention illustrates a case where heat exchanging areas are provided in a refrigerant tank portion 1A and a refrigerant diffusing portion 1C.

As shown in FIGS. 1 and 2, the pressed members 3A, 3B, 3C, that are used for the refrigerant tank portion 1A, and the pressed members 3H, 3I, that are used for the refrigerant diffusing portion 1C, are set smaller in width (in the transverse direction as viewed in FIG. 1) than the pressed members 3E, 3F that are used for the heat exchanging portion 1B.

Figure 18:
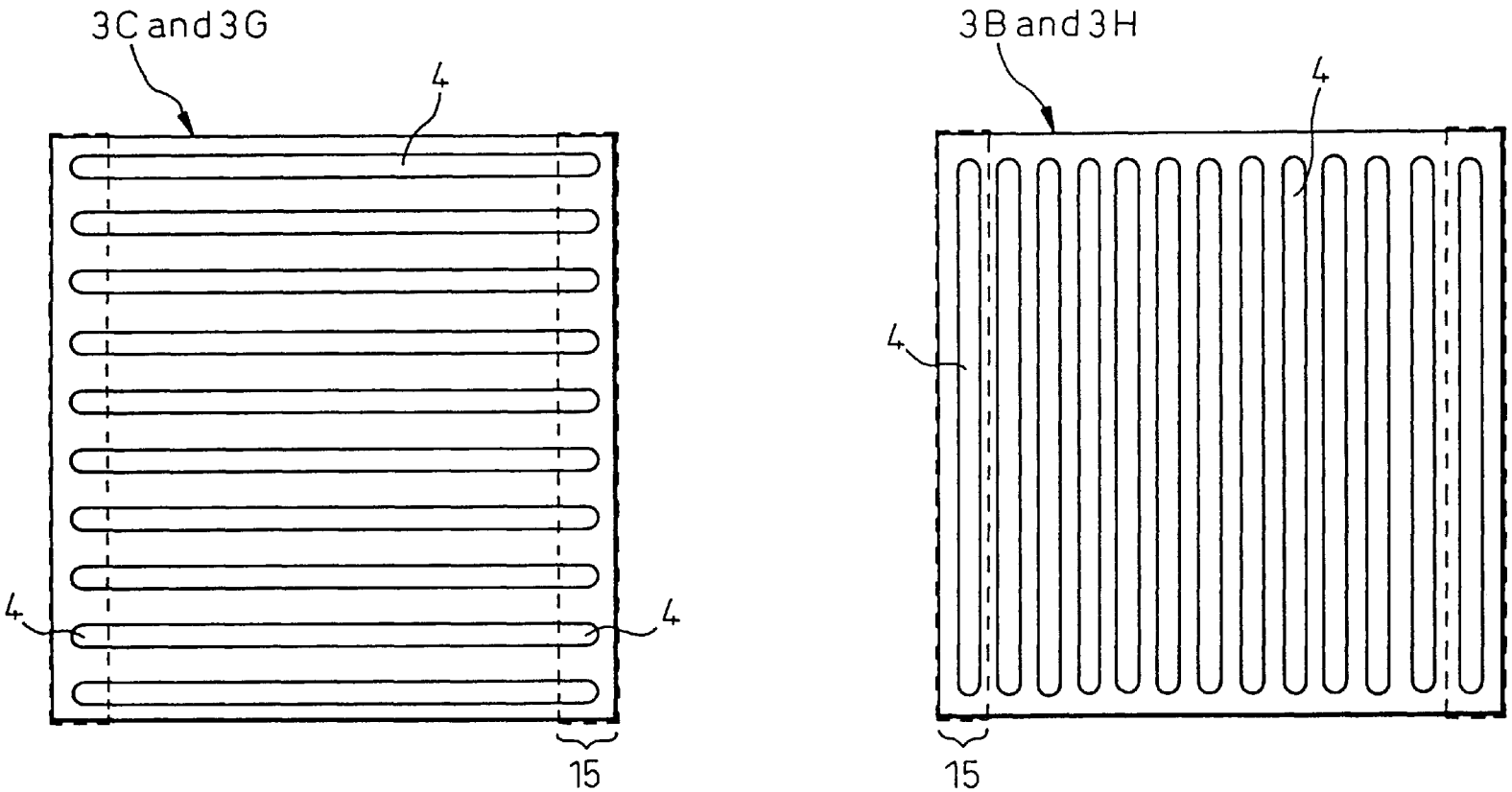
FIG. 18 shows plan views of pressed members that are used for a refrigerant tank portion and a refrigerant diffusing portion (the fourth embodiment)

On the contrary, in the fourth embodiment, as shown in FIG. 17, the widths of pressed members 3A to 3C, 3H, 3I, that are used for a refrigerant tank portion 1A, and a refrigerant diffusing portion 1C are made equal to those of pressed members 3E, 3F, that are used for a heat exchanging portion 1B, and heat exchanging portions 15 (openings 4) are provided in extended portions (portions indicated by broken lines in FIG. 18) for executing heat exchange with cooling water flowing through tank portions (communicating portions 7) in the heat exchanging portion 1B.

(Fifth Embodiment)

Figure 19:
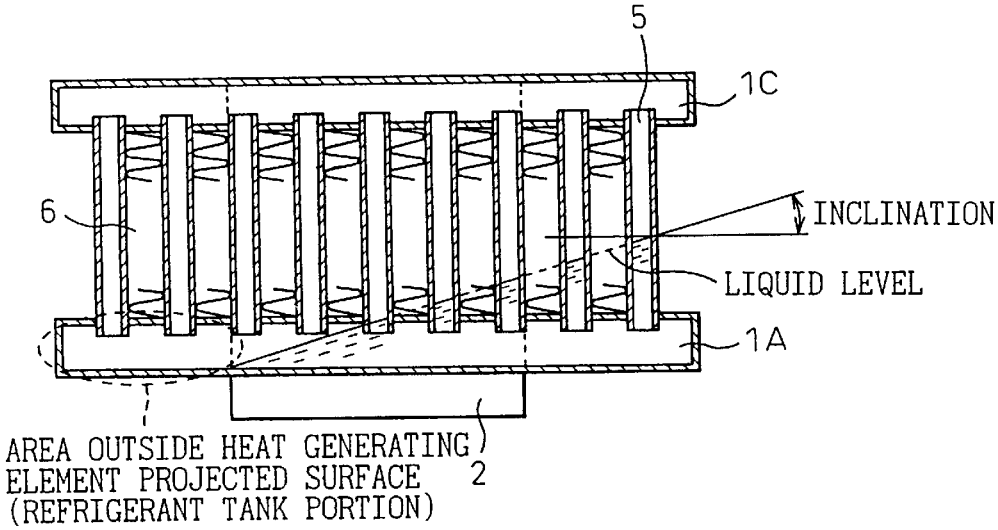
FIG. 19 is a sectional view showing typically the internal construction of a cooling apparatus (a fifth embodiment)

FIG. 19 is a sectional view showing typically the internal construction of a cooling apparatus 1 boiling and condensing refrigerant.

As shown in FIG. 19, the cooling apparatus 1 according to a fifth embodiment has a heat generating element 2 attached to a substantially central portion of a refrigerant tank portion 1A (a substantially central portion on the surface of an outer pressed member 3A), and the internal capacity of a portion of the refrigerant tank portion 1A which belongs to an area thereof which is outwardly of the heat generating element 2 is set larger than the internal capacity of a portion of the refrigerant tank portion 1A which belongs to an area thereof where the heat generating element 2 is attached.

Figure 20:
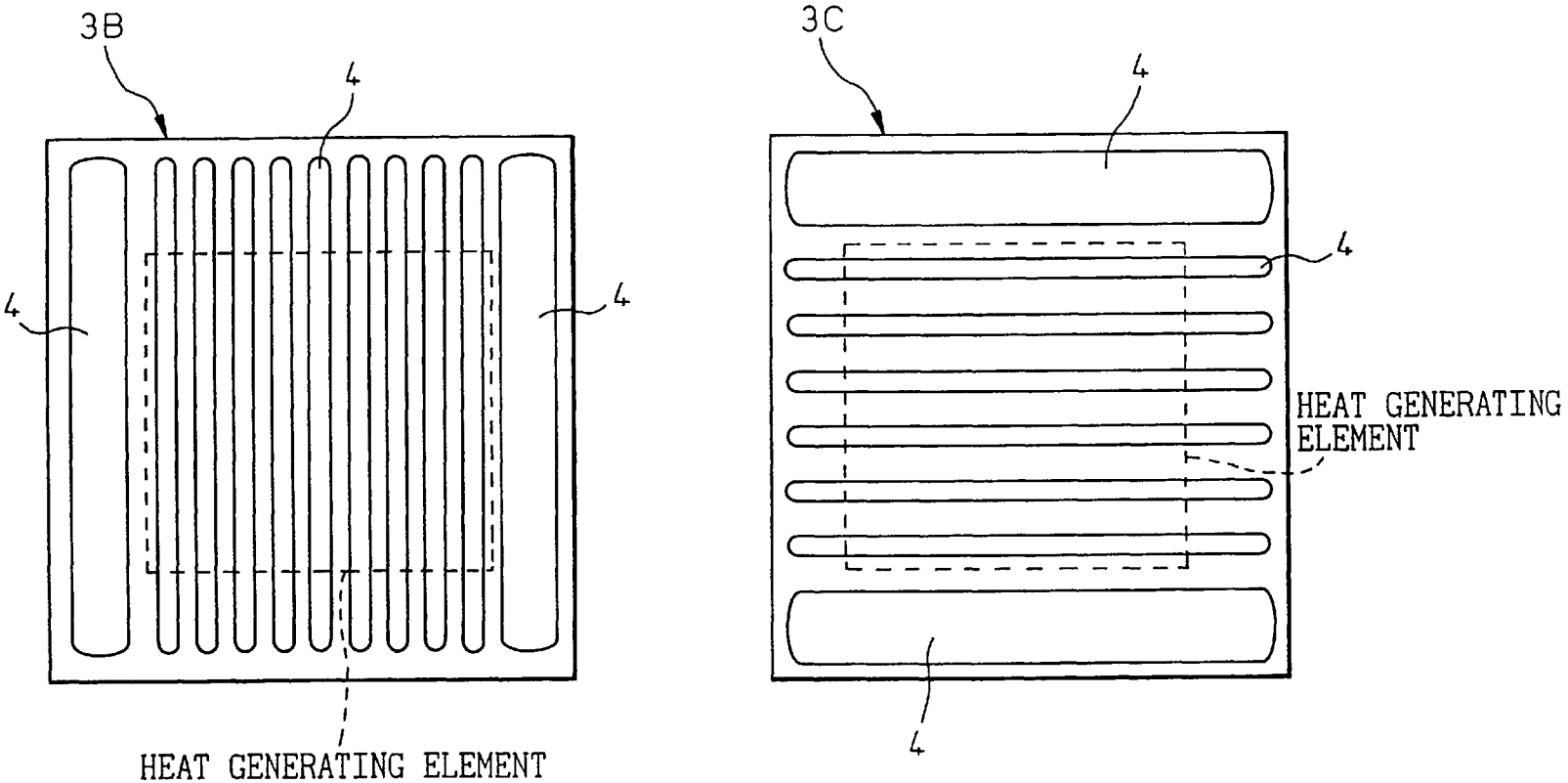
FIG. 20 shows plan views of pressed members for use for a refrigerant tank portion (the fifth embodiment)

To be specific, as shown in FIG. 20, this construction can be realized by providing wide openings 4 which open wide in areas of the pressed members 3B, 3C that are used for the refrigerant tank portion 1A and which are situated outward of the heat generating element 2.

According to the construction, as the internal capacity of the portion of the refrigerant tank portion 1A which belongs to the area thereof, which is situated outward of the heat generating element 2, can be increased, there can be obtained an advantage that the deterioration in cooling performance can be suppressed which would result when the cooling apparatus 1 were used in the tilted posture as has been described with respect to the third embodiment.

(Sixth Embodiment)

Figure 21:
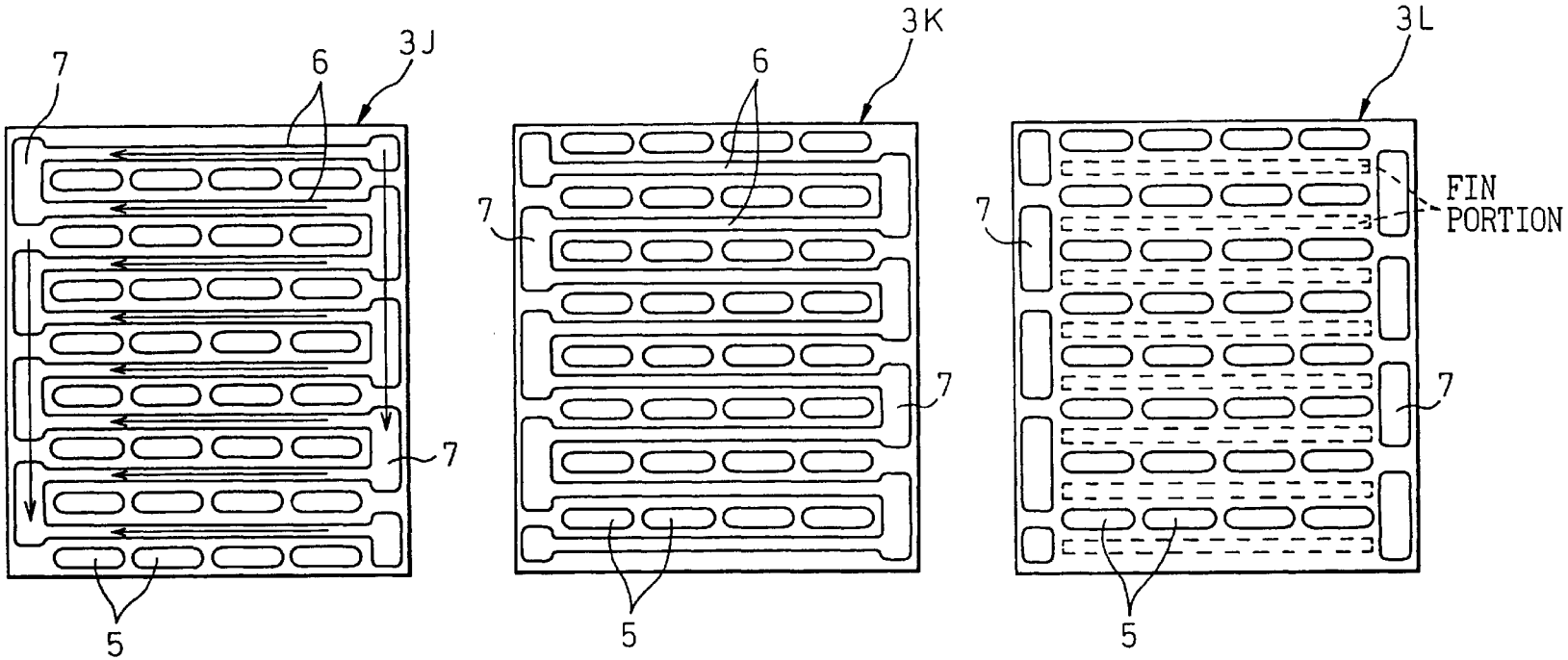
FIG. 21 shows plan views of pressed members for use for a heat exchanging portion (a sixth embodiment)

FIG. 21 shows plan views of pressed members 3 that are used for a heat exchange portion 1B according to a sixth embodiment.

In this sixth embodiment, opening patterns in the pressed members 3 that are used for the heat exchanging portion 1B of a cooling apparatus boiling and condensing refrigerant are modified, and as an example, three types of pressed members 3J, 3K, 3L shown in FIG. 21 are used.

The pressed members 3J and 3*k* are such as to correspond to the pressed members 3E and 3F in the first embodiment, and as shown in FIG. 21, provided therein are elongated hole-like first openings 5 which form part of refrigerant passages, passage-like second openings 6 which form refrigerant passages and communicating portions 7 which constitute tank portions of cooling water passages.

The pressed members 3J, 3K differ from the pressed members 3E, 3F of the first embodiment in that the passage-like second openings 6 are formed to extend long along the lateral direction (a transverse direction as viewed in FIG. 21) of the pressed members 3J, 3K with no pillar portions being formed at intermediate positions along the length of the passage-like openings 6, and the elongated hole-like openings 5 and the communicating portions 7 can be provided similarly to the first embodiment.

As shown in FIG. 21, formed in the pressed member 3L are elongated hole-like first openings 5 which form part of refrigerant passages and communicating portions 7 which constitute tank portions of cooling water passages. The first openings 5 in the pressed member 3L are formed at the same positions as those of the first openings 5 in the pressed members 3J, 3K, and the communicating portions 7 in the pressed member 3L are formed in such positions that allow them to communicate with the communicating portions 7 in the pressed members 3J, 3K. However, the thickness of the pressed member 3L is set thinner than those of the other pressed members 3J, 3K (for example, to a thickness of 0.2 to 0.5 mm). The thickness of the pressed members 3J, 3K is in a range of 1.0 to 2.0 mm.

Figure 22:
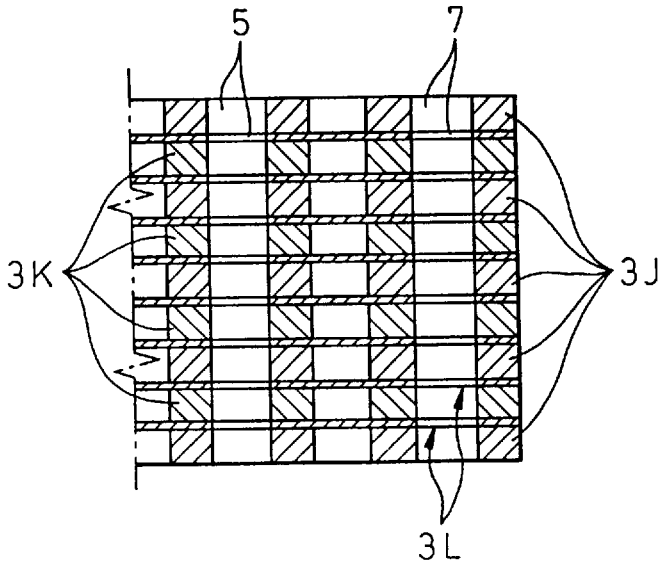
FIG. 22 is a sectional view showing the heat exchanging portion (the sixth embodiment)

The three types of pressed members 3J, 3K, 3L are, as shown in FIG. 22, stacked in multiple stages with the pressed member 3L being inserted between the pressed members 3J and 3K. In this condition, the first openings 5 in the respective pressed members 3J, 3K, 3L are allowed to communicate with one another in the stacked direction so as to form refrigerant passages, and the communicating portions 7 in the respective pressed members 3J, 3K, 3L are allowed to communicate with one another so as to form the tank portions. In addition, the passage-like second openings 6 formed, respectively, in the pressed members 3J, 3K are closed with the pressed members 3L on upper and lower sides thereof.

In the heat exchanging portion 1B according to this embodiment, as the second openings 6 formed, respectively, in the pressed members 3J and 3K are closed with the thinner pressed members 3L on the upper and lower sides thereof by inserting the thinner pressed members 3L between the pressed members 3J and the pressed members 3K, portions of the pressed members 3L indicated by broken lines in FIG. 21 can have the role of a fin, whereby the heat conducting surface area on the cooling water side can be increased, whereby heat exchanges are promoted, thereby making it possible to increase the cooling performance.

In addition, the heat conducting surface area is increased by inserting the inner fins 14 into the cooling water passages in the second embodiment, and this method suffers from impractical aspects, such as increased costs, due to inserting failures of the inner fins resulting from difficulty in dimensional control required when the inner fins are actually inserted into the refrigerant tank portion and due to increase in the man-hours required for assembly.

In contrast to this, according to the construction of the sixth embodiment, as the pressed members 3L which are used for the heat exchanging portion 1B can be imparted the role of the inner fins, there is no need to additionally insert inner fins into the cooling water passages, and therefore, the problems inherent in the second embodiment can be solved.

In addition, in this embodiment, a leakage of hermetically sealed gas resulting from the corrosion of the pressed members L can be prevented by affixing sacrificial materials (not shown) to one side (or both sides) of the pressed members 3L. Namely, in the event that the pressed members 3L made of a metal (for example, of aluminum) are corroded by the cooling water, there may be a risk that the refrigerant passage and the cooling water passage are permitted to communicate with each other to thereby cause a leakage of hermetically sealed gas. In contrast to this, the corrosion of the pressed members 3L can be suppressed by affixing the sacrificial materials on the pressed members 3L, thereby making it possible to prevent the occurrence of a leakage of hermetically sealed gas.

In many cases the sacrificial materials are used on, for example, automotive radiators, and a metallic material is used which has a lower corrosion resistance against the cooling water than that of the pressed members 3L. For example, in the event that the pressed member 3L is made of aluminum, an aluminum material containing Zn (zinc) is used for the sacrificial material.

In addition, a cladding material having a layer of a wax material applied to one side thereof in advance is used for the respective pressed members 3L that are used in the cooling apparatus 1 according to the embodiment, and the respective pressed members 3L are stacked one on another to fabricate the cooling apparatus 1 and thereafter, an integral brazing is applied thereto. Consequently, in the event that the sacrificial materials are provided on the surface of the pressed members 3L, the sacrificial materials are affixed to an opposite side to the side to which the layer of wax material is applied. However, the application of the sacrificial materials to the pressed members 3L is not limited thereto. In the event that no layer of wax material is provided on the pressed members 3L, the sacrificial materials can be provided on both sides of the pressed members 3L. In addition, the sacrificial materials may be provided not only on the thinner pressed members 3L but also on the pressed members 3J or the pressed members 3K.

(Seventh Embodiment)

Figure 23:
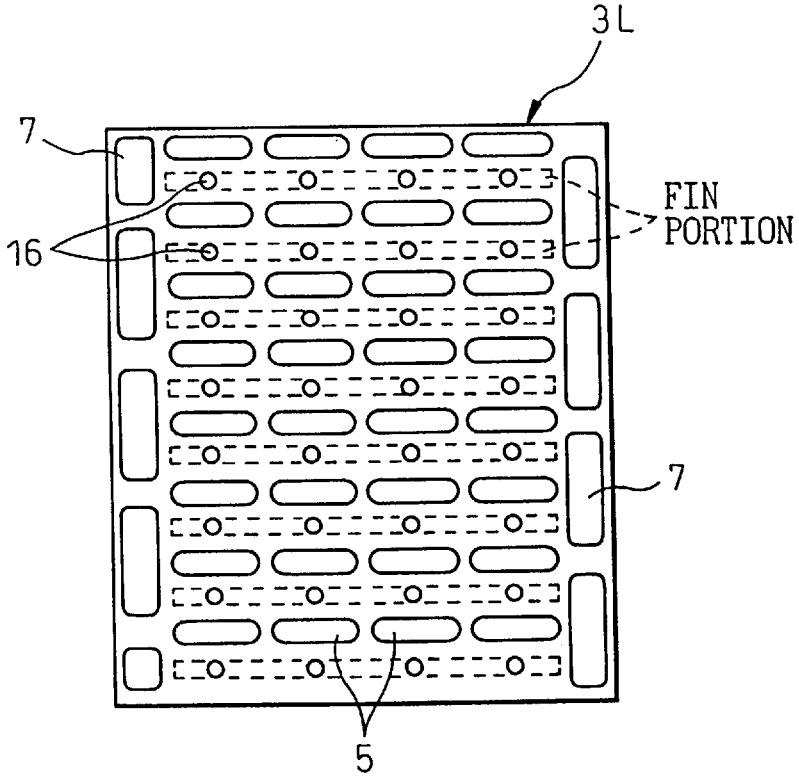
FIG. 23 is a plan view of a thin pressed member for use for a heat exchanging portion (a seventh embodiment)

FIG. 23 shows a plan view of a pressed member 3L.

A seventh embodiment describes another example related to the thinner pressed members 3L among the three types of pressed members 3J, 3K, 3L which are described in the sixth embodiment.

Formed in the pressed member 3L at portions playing the role of the fins (those indicated by broken lines in FIG. 23) are communicating ports 16 which communicate with the second openings 6 in the pressed member 3J and the second openings 6 in the pressed member 3K.

According to the construction, as the cooling water can flow through a heat exchanging portion 1B in the stacked direction as well by passing through the communicating ports 16 formed in the pressed members 3L, the construction can contribute to an improvement in cooling performance. Note that the number, configuration and size of the communicating portions 16 may be modified as desired.

(Eighth Embodiment)

Figure 24:
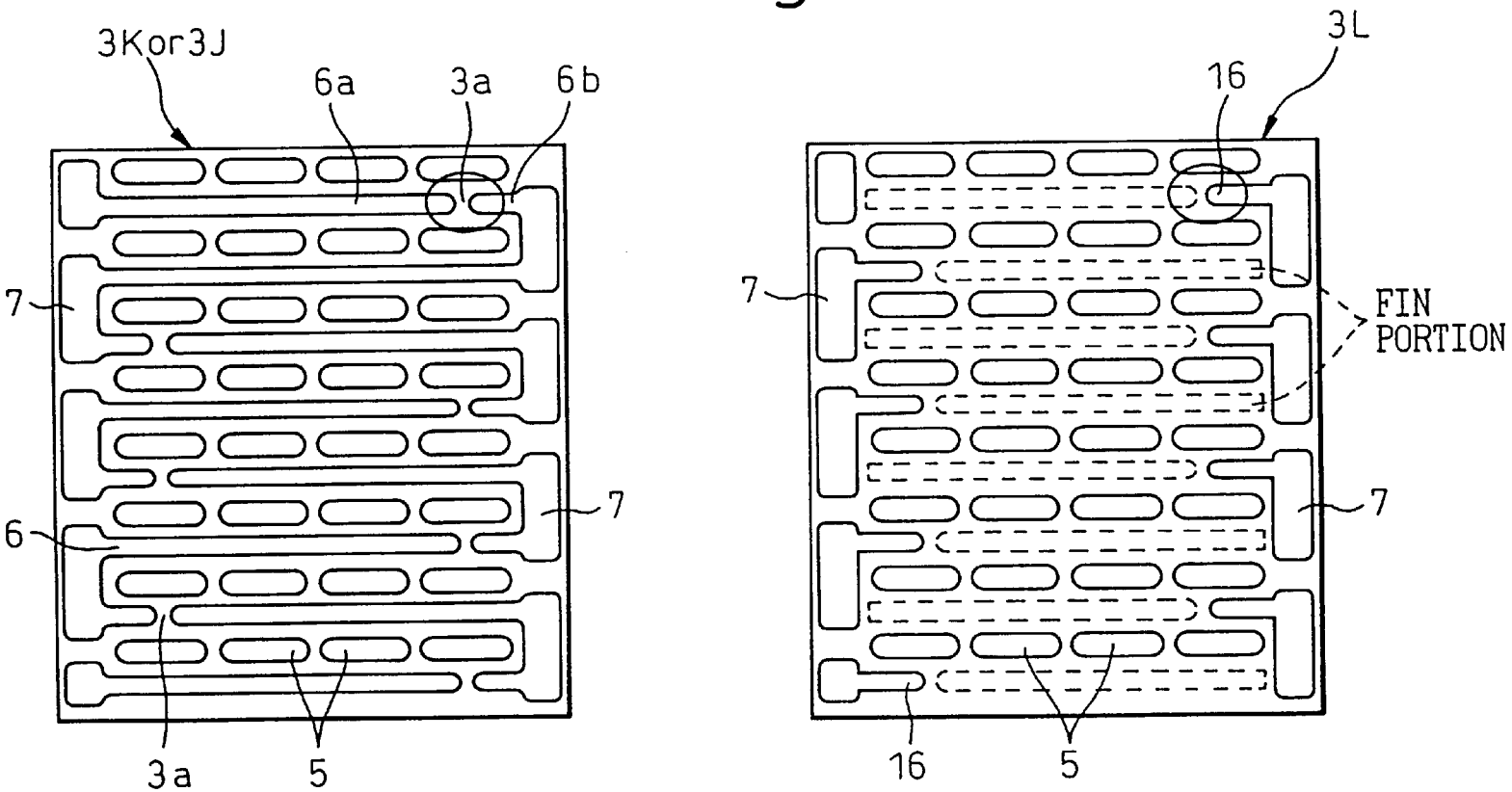
FIG. 24 shows plan views of pressed members for use for a heat exchanging portion (an eighth embodiment)

FIG. 24 shows plan views of a pressed member 3K (or 3J) and a pressed member 3L.

While the sixth embodiment shows the example in which the second openings 6 formed in the pressed members 3J, 3K are such as to extend in the passage-like fashion with no pillar portion being formed at the intermediate positions along the length of the openings, an eighth embodiment shows an example in which pillar portions **3*a* are formed in the pressed member 3K (or in the pressed member 3J), as shown in FIG. 24, so that each second opening 6 is divided into a second opening portion 6*a* and another second opening portion 6*b*. The strength of the pressed member 3K can be increased by providing the pillar portions 3*a*** like this.

However, as the provision of the pillar portions **3*a* in the pressed member 3K cuts off the flow of cooling water by the pillar portions 3*a*, there is required a construction in which the cooling water flows by by-passing the pillar portions 3*a*. Then, communicating ports 16 formed in the pressed member 3L are, as shown in FIG. 24, formed to a size that can establish a communication between the second opening portions 6*a* and the other second opening portions 6*b* which are divided by the pillar portions 3*a*, whereby the cooling water can flow from the second opening portions 6*a* to the other second opening portions 6*b* by passing through the communicating ports 16**.

(Ninth Embodiment)

Figure 25:
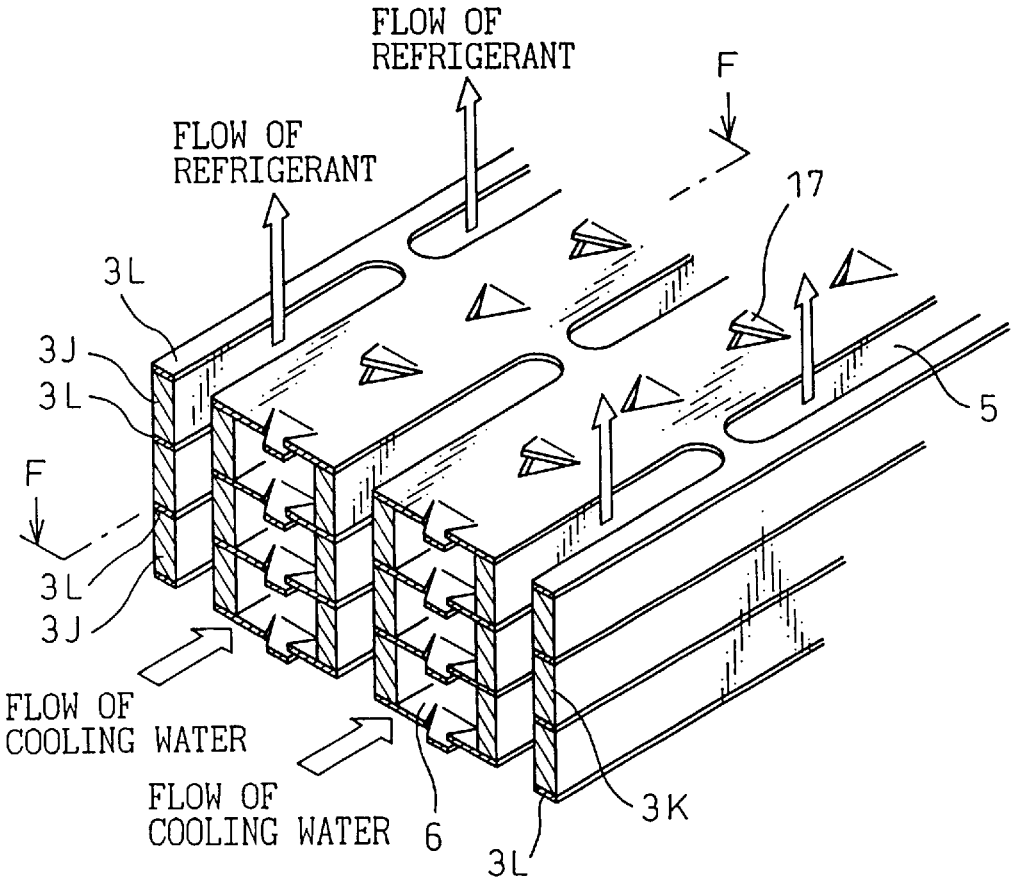
FIG. 25 is a perspective view showing typically a heat exchanging portion (a ninth embodiment)

FIG. 25 is a perspective view showing typically a heat exchanging portion 1B.

A ninth embodiment shows an example in which cut and erected pieces 17 are provided in the thin pressed members 3L which has been described in the sixth embodiment.

Cut and erected pieces 17 are provided in the pressed members 3L at the portions indicated by the broken lines which are adapted to play the role of the fins as shown in FIG. 21, and the cut and erected pieces 17 protrude into second openings 6 which form cooling water passages. As shown in FIG. 25, the cut and erected pieces 17 are cut and erected in a direction which opposes a direction in which cooling water flows (in a direction indicated by arrows in the figure), and a plurality of cut and erected pieces are provided along the flowing direction of the cooling water at substantially equal intervals. In addition, any adjacent cut and erected pieces 17 in the flow direction of the cooling water are set such that the directions, in which the cut and erected pieces 17 are cut and erected, are opposite to each other (refer to FIG. 26).

According to this embodiment, vertical vortexes are induced in the cooling water which flows through the cooling water passages (the second openings 6) by the action of the cut and erected pieces 17 so as to the promotion the conduction of heat (turbulent flows).

Figure 26:
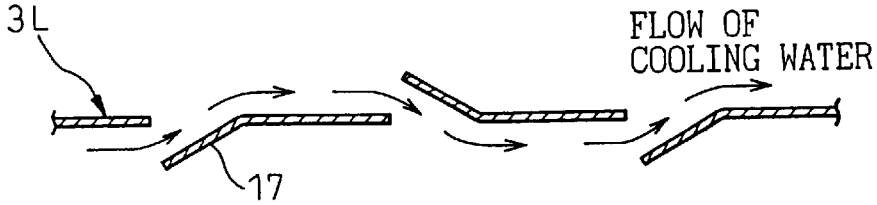
FIG. 26 is a sectional view of a pressed member having cut and erected pieces taken along the line F—F in FIG. 25 (the ninth embodiment)

In addition, as shown by a broken-line arrow in FIG. 26, an effect which occurs at a front edge of a boundary layer can also be obtained when the cooling water flows in a winding (meandering) fashion by passing through gaps formed by the cut and erected pieces 17, whereby an increase in cooling performance in association with an increase in heat conductivity can be expected.

Note that while the cut and erected pieces 17 shown in FIG. 25 are formed into a triangular shape, there is no need to impose a limitation on the shape of the cut and erected pieces, and therefore, for example, a quadrangular or circular shape may be used.

(Tenth Embodiment)

Figure 27:
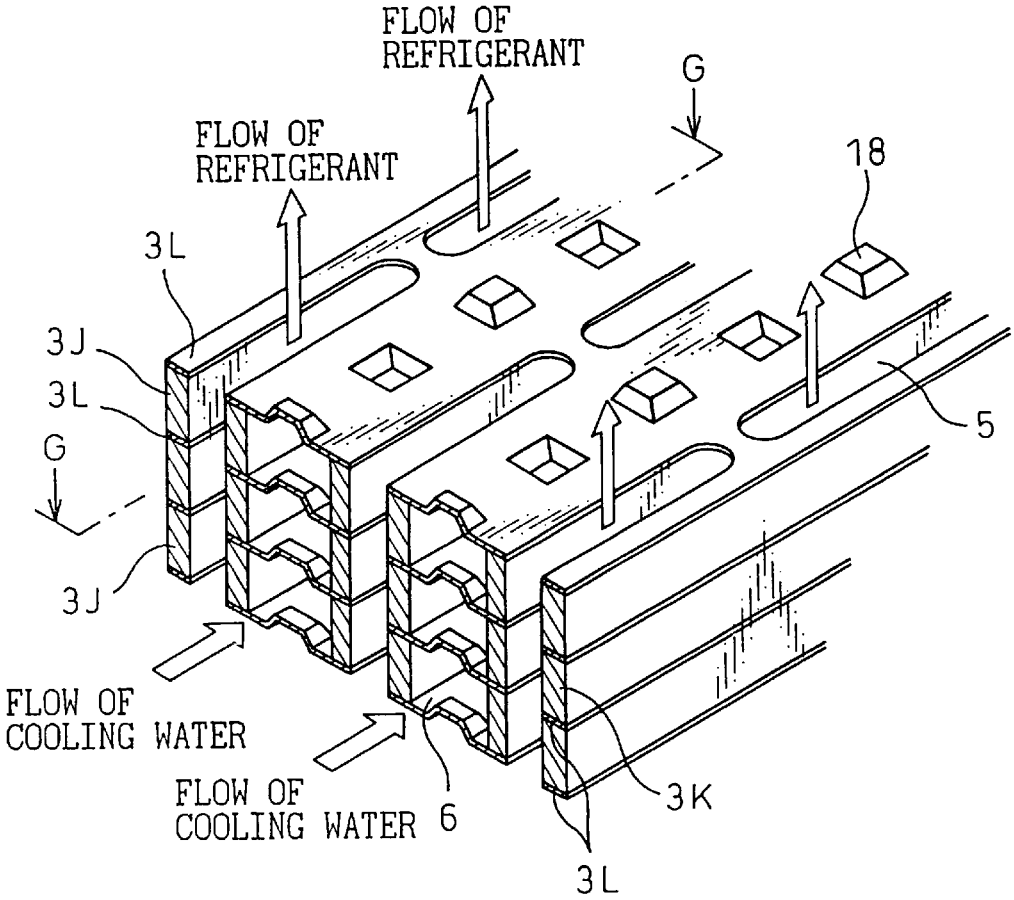
FIG. 27 is a perspective view showing typically a heat exchanging portion (a tenth embodiment)

FIG. 27 is a perspective view showing typically a heat exchanging portion 1B.

A tenth embodiment shows an example in which the surfaces of the pressed members 3L are finished to have irregularities thereon.

Embossed portions 18 are provided on the pressed members 3L at the portions indicated by the broken lines which are adapted to play the role of the fins as shown in FIG. 21. As shown in FIG. 27, the embossed portions 18 are such as to finish the surfaces of the pressed members 3L in an irregular fashion, and a plurality of embossed portions are provided in the flowing direction of the cooling water (the direction indicated by arrows in the figure) at substantially equal intervals, any adjacent embossed portions 18 in the flowing direction of the cooling water being driven out in opposite directions relative to the surface of the pressed member 3L (refer to FIG. 27).

Figure 28:
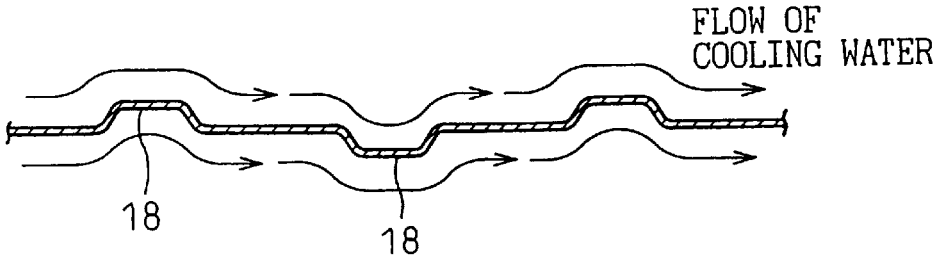
FIG. 28 is a sectional view of a pressed member having embossed portions taken along the line G—G in FIG. 27 (the tenth embodiment)

According to the embodiment, as shown in FIG. 28, as the cooling water flowing through the cooling water flows in a wave fashion in the vicinity of the surface of the pressed member 3L, vertical vortexes are induced in the cooling water passages, thereby making it possible to promote the conduction of heat (turbulent flows). Note that while the embossed portions 18 shown in FIG. 27 are formed into a quadrangular shape, there is no need to impose a limitation to the shape of the embossed portions, and therefore, for example, a triangular or circular shape may be used.

(Eleventh Embodiment)

Figure 29:
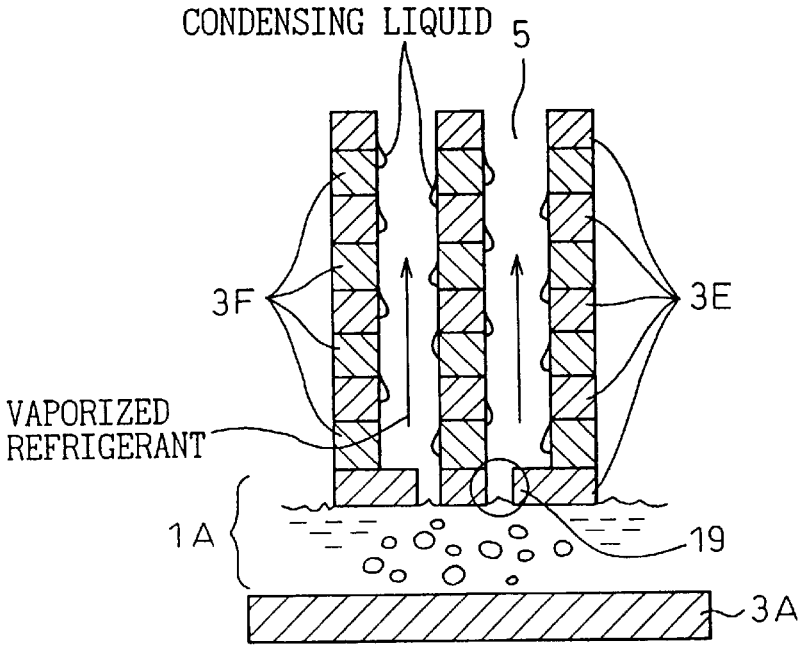
FIG. 29 is an exemplary view showing typically the internal constructions of a refrigerant tank portion and a heat exchanging portion (an eleventh embodiment)
Figure 30:
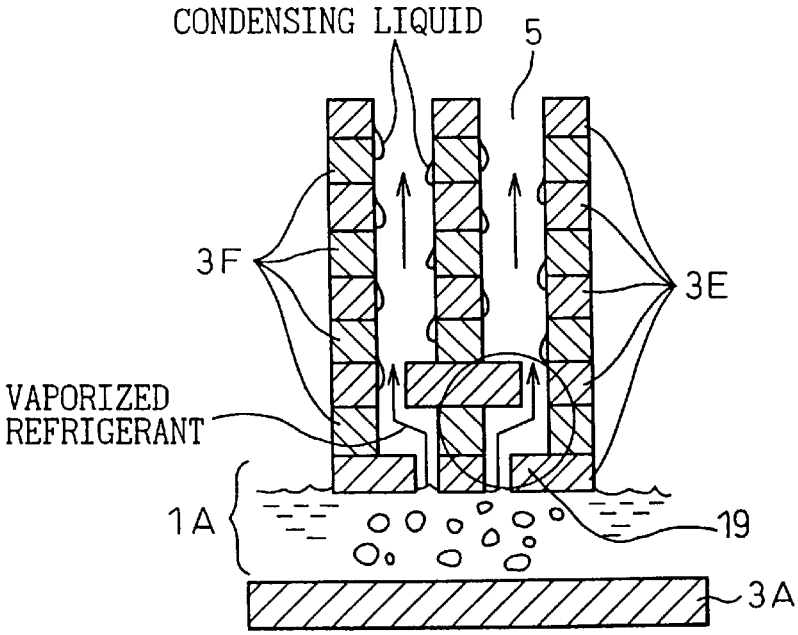
FIG. 30 is an exemplary view showing typically the internal constructions of the refrigerant tank portion and the heat exchanging portion (the eleventh embodiment)

FIGS. 29 and 30 are exemplary views showing typically the internal constructions of a refrigerant tank portion 1A and a heat exchanging portion 1B.

Figure 31:
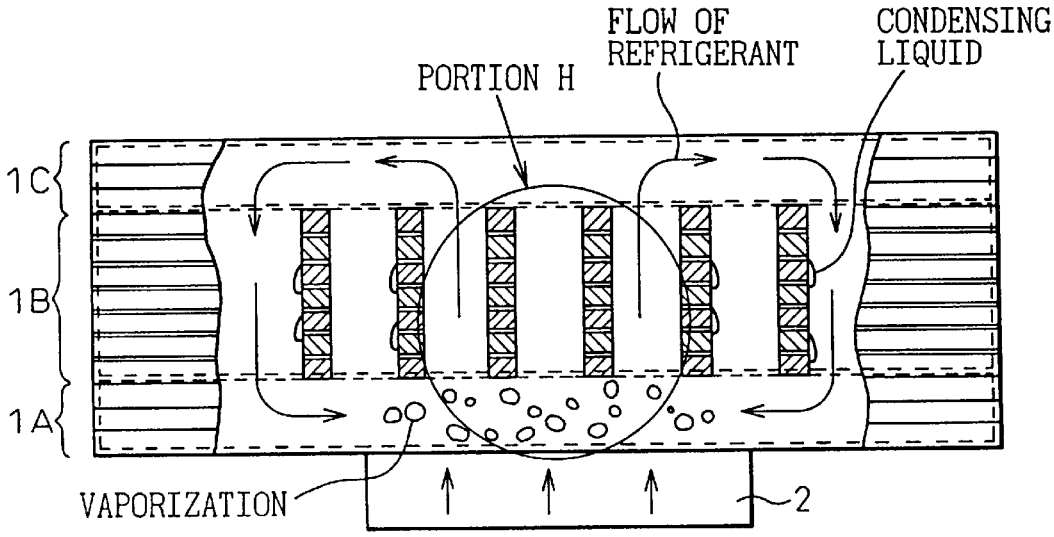
FIG. 31 is an exemplary view showing typically the internal construction of the cooling apparatus (the first embodiment)
Figure 32:
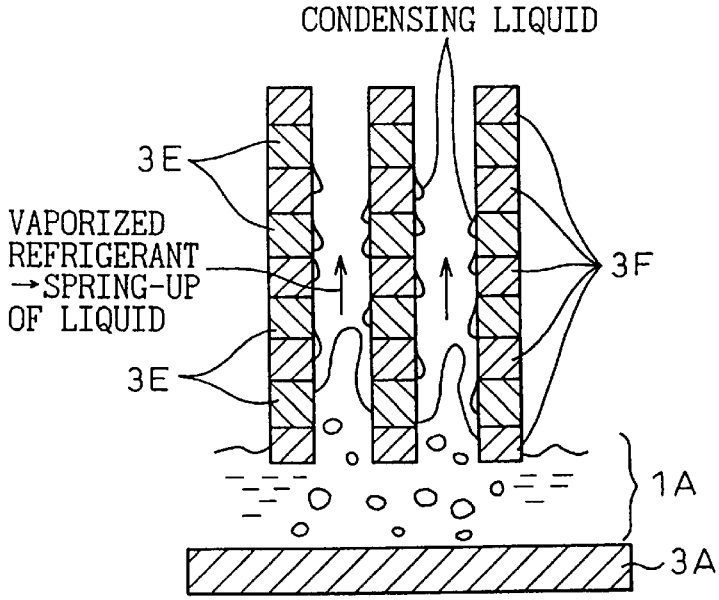
FIG. 32 is an enlarged view of a portion H shown in FIG. 31.

In the cooling apparatus 1 described in the first embodiment, as the refrigerant tank portion 1A and the heat exchanging portion 1B are provided adjacent to each other in the stacked direction, as shown in FIG. 31, there is a possibility that the respective phenomena (vaporization and condensation) are affected. Namely, when the thermal load from the heat generating element 2 becomes large in the refrigerant tank portion 1A, as shown in FIG. 32, there may occur a case where the liquid refrigerant boils up into the heat exchanging portion 1B, which should normally be kept filled with vaporized refrigerant. As this occurs, and in the event that the liquid refrigerant penetrates into the refrigerant passages in the heat exchanging portion 1B, the actual condensing surface area in the heat exchanging portion 1B is decreased to thereby deteriorate the cooling performance.

To cope with this, in the embodiment shown in FIG. 29 or FIG. 30, barrier wall portions 19 (for example, labyrinth constructions) are provided within the refrigerant passages (first openings 5) which allow the refrigerant tank portion 1A to communicate with the heat exchanging portion 1B.

With this construction, even if the thermal load from the heat generating element 2 becomes large in the refrigerant tank portion 1A, as the boiling up of the liquid refrigerant can be prevented by the barrier wall portions 19, the penetration of the liquid refrigerant into the refrigerant passages in the heat exchanging portion 1B can thus be suppressed to thereby suppress the deterioration in cooling performance.

(Twelfth Embodiment)

Figure 33:
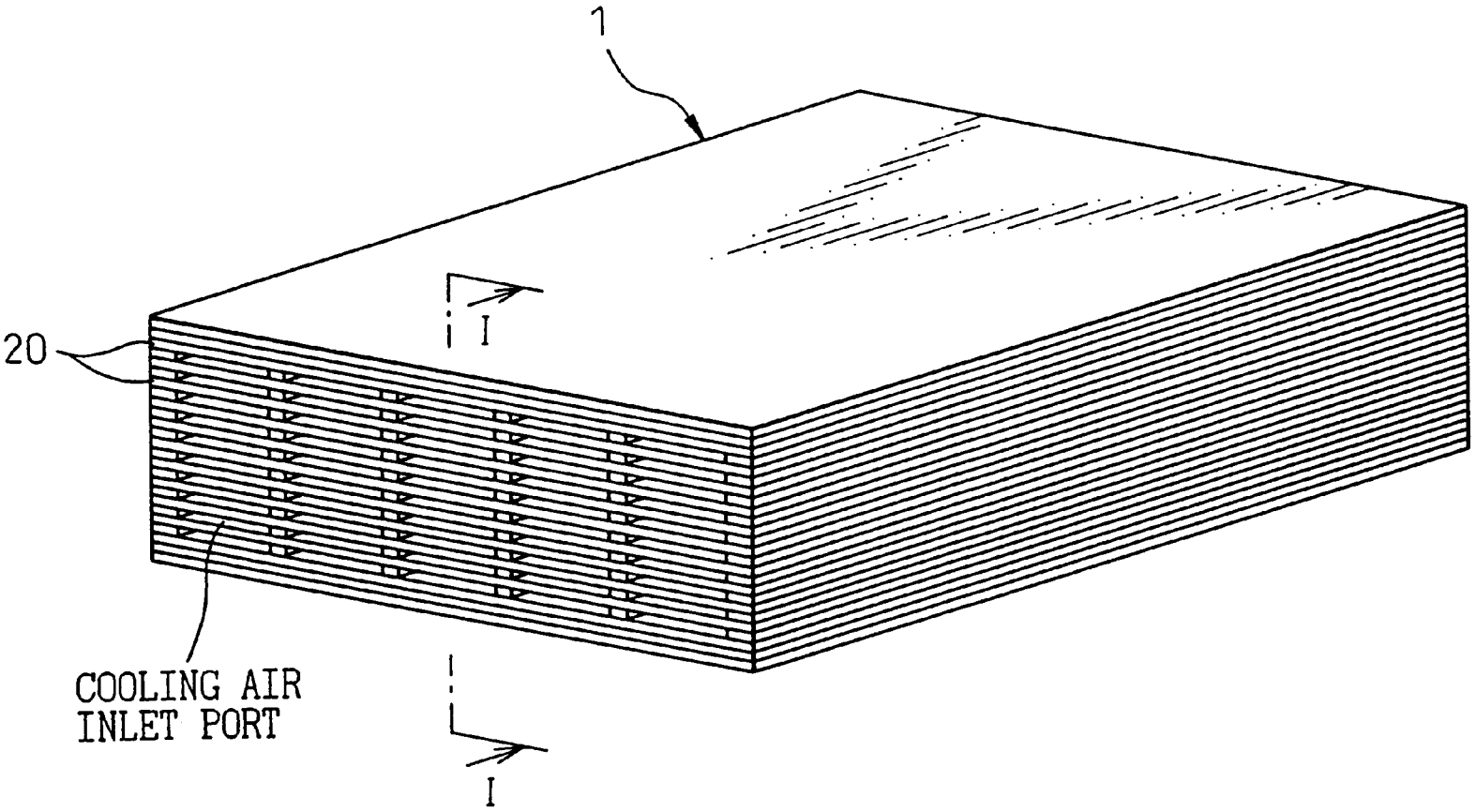
FIG. 33 is an overall perspective view of a cooling apparatus according to the invention (a twelfth embodiment)

FIG. 33 is an overall perspective view of a cooling apparatus boiling and condensing refrigerant.

Figure 34:
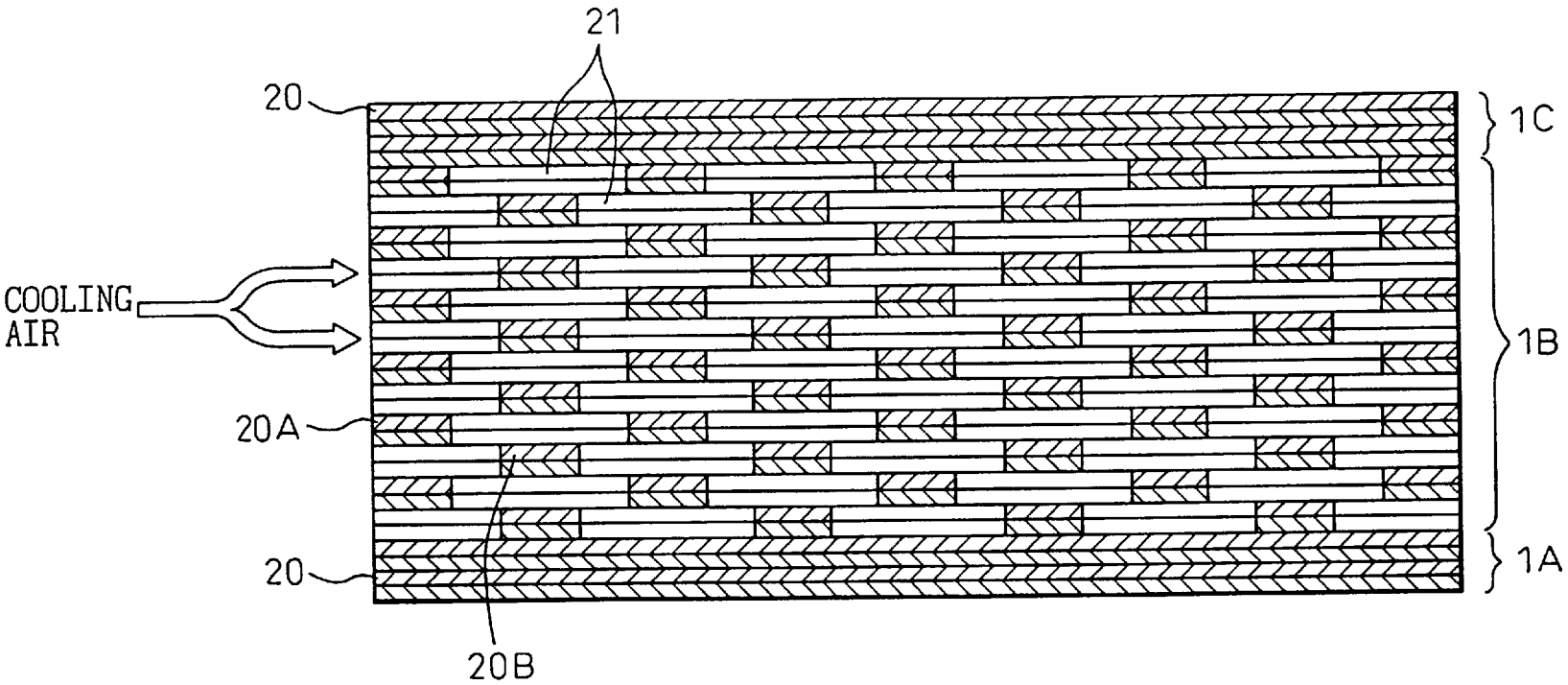
FIG. 34 is a side sectional view of the cooling apparatus according to the invention taken along the I—I line in FIG. 33 (the twelfth embodiment)

Similar to the first embodiment, the cooling apparatus 1 according to a twelfth embodiment has a stacked construction in which a plurality of plates 20 (plate-like members of the invention) are stacked one on another and comprises, as shown in FIG. 34, a refrigerant tank portion 1A for storing therein a refrigerant, a heat exchanging portion 1B for cooling the refrigerant that boils when receiving heat from a heat generating element 2 in the refrigerant tank portion 1A through heat exchange between the boiling refrigerant and a cooling medium (cooling air in this embodiment), and a refrigerant diffusing portion 1C for diffusing the vaporized refrigerant that flows thereinto from the refrigerant tank portion 1A by passing through the heat exchanging portion 1B.

The refrigerant tank portion 1A and the refrigerant diffusing portion 1C have the same construction, and internal spaces are formed therein and communicate with refrigerant passages in the heat exchanging portion 1B. Opening patterns in a plate 20 for use for the refrigerant tank portion 1A and the refrigerant diffusing portion 1C can optionally be selected depending upon conditions in which the cooling apparatus 1 is used. For example, as with the first embodiment, the opening pattern having the plurality of slit-like openings may be used, or an opening pattern may be adopted in which a large opening is formed over the entirety of the plate 20.

The heat exchanging portion 1B is formed by alternately stacking two types (or three or more types) of plates 20A, 20B having different opening patterns. Note that in FIG. 34 two stacked plates of each of the two types of plates 20A, 20B are stacked alternately.

Examples of the plates 20A, 20B that are used for the heat exchanging portion 1B are shown in FIG. 25.

Figure 35:
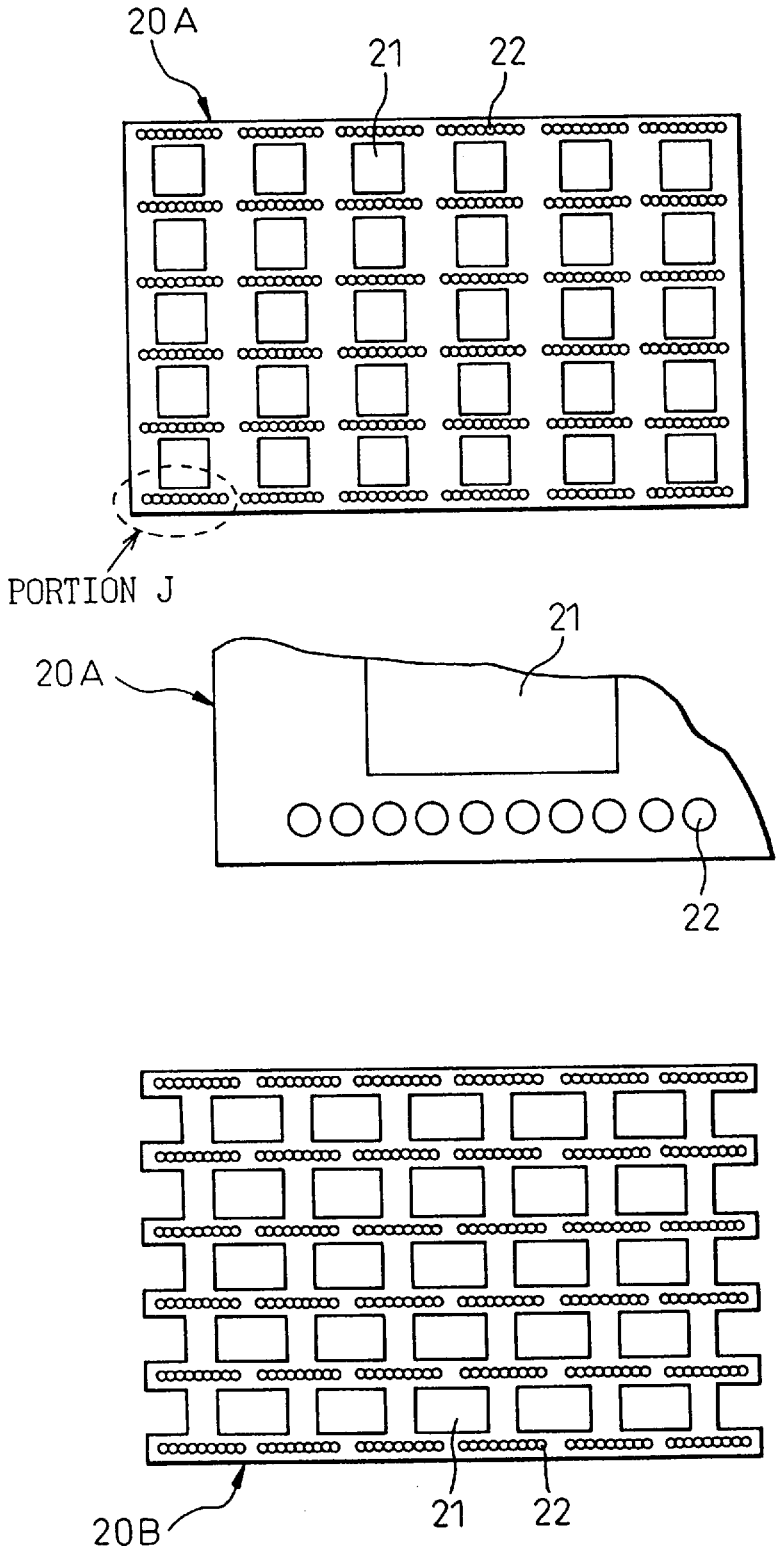
FIG. 35 shows plan views of pressed members for use for a heat exchanging portion and an enlarged view of a portion J (the twelfth embodiment)
Figure 36:
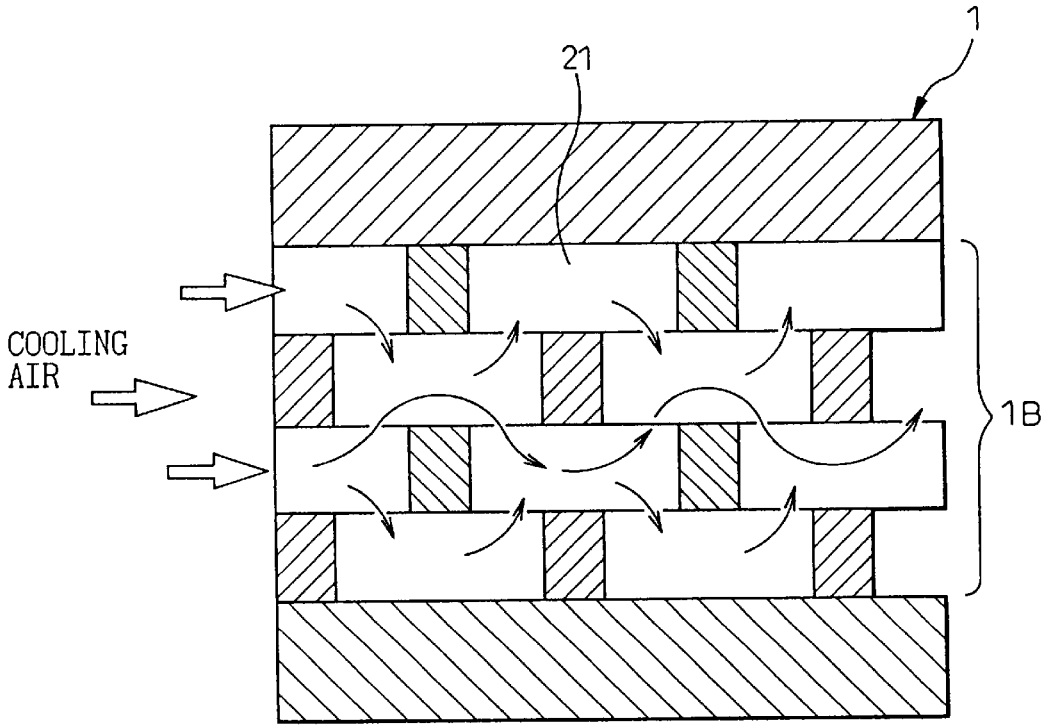
FIG. 36 is an exemplary view of the cooling apparatus showing typically the flow of cooling air (the twelfth embodiment)

In the plates 20A, 20B, a plurality of openings 21 (rectangular holes) for passing cooling air are formed, respectively, at regular arrangement pitches in a longitudinal direction (a horizontal direction as viewed in FIG. 35) and a transverse direction (a vertical direction as viewed in FIG. 35). However, the positions of the openings 21 are offset by half the pitch in the longitudinal direction in the two types of plates 20A, 20B. In addition, as shown in FIG. 35, in the plate 20B, the openings 21 disposed at longitudinal ends thereof are opened at end faces of the plate 20B to thereby form inlet ports and outlet ports, whereby when the two types of plates 20A, 20B are stacked alternately one on another, the respective openings 21 are allowed to communicate with one another in a state in which the openings 21 are offset from one another by half the pitch, and cooling air passages are formed between the inlet ports and the outlet ports which extend in a winding (meandering) fashion in the plates 20A, 20B in the longitudinal and stacked directions thereof (refer to FIGS. 36 and 37).

Figure 37:
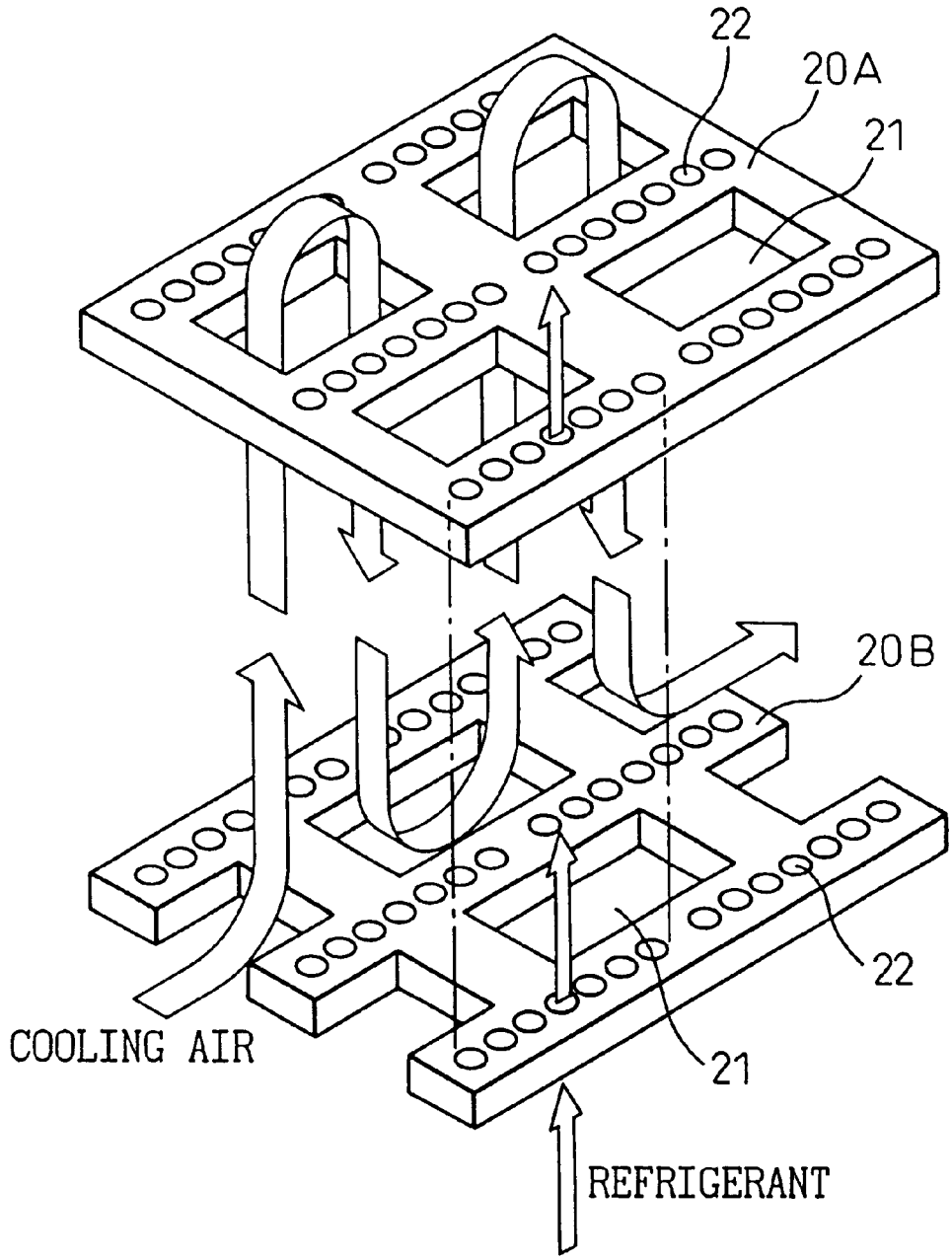
FIG. 37 is perspective views of two different types of plates which show the flows of cooling air and refrigerant (the twelfth embodiment).

In addition, as shown in an enlarged view of a portion J in FIG. 35, a plurality of openings 22 (circular holes) for passing refrigerant are formed between any two openings 21 that are disposed in the lateral direction of the plates 20A, 20B. The openings 22 are provided at the same positions in the two types of plates 20A, 20B as shown in FIG. 37, and when the two types of plates 20A, 20B are stacked on each other, the openings 21 in the respective plates communicate with one another in a vertical direction (the stacked direction) to thereby form refrigerant passages, as well as with internal spaces of the refrigerant tank portion 1A and the refrigerant diffusing portion 1C.

Next, the function of the cooling apparatus illustrated in this embodiment will be described.

The refrigerant that boils when receiving heat from the heat generating element 2 flows from the refrigerant tank portion 1A into the refrigerant diffusing portion 1C by passing through the respective refrigerant passages (the openings 22) in the heat exchanging portion 1B and then flows into the respective refrigerant passages again in a dispersed fashion after the refrigerant has been diffused in the refrigerant diffusing portion 1C.

On the other hand, when the cooling air as the cooling medium flows through the cooling air passages (the openings 21) in the heat exchanging portion 1B, heat exchange is executed between the vaporized refrigerant filling the refrigerant passages and the cooling water flowing through the cooling water passages, and the refrigerant that condenses when cooled returns to the refrigerant tank portion 1A, whereby the heat generated from the heat generating element 2 is delivered from the refrigerant tank portion 1A to the heat exchanging portion 1B (the refrigerant passages) by virtue of the vaporization of the refrigerant and is then emitted to the cooling water as latent heat when the refrigerant condenses when it is cooled in the heat exchanging portion 1B.

(Effectiveness of Twelfth Embodiment)

As with the first embodiment, as the cooling apparatus 1 according to the embodiment has the stacked construction which is formed by stacking the plurality of plates 20 are stacked one on another, the flow of the cooling air as the cooling medium can be freely adjusted by changing the configuration, type, stacking order and number of stacked plates 20, whereby the cooling air is allowed to flow not only in the longitudinal direction of the heat exchanging portion 1B but also in the vertical direction (the stacked direction) and the lateral direction (the transverse direction). In addition, when the air flow resistance constitutes a problem, as the cooling air flows in the form of a large wave by combining plates 20 in which the arrangement pitch of the openings 21 is offset within a small range of in the order of, for example, 3 to 15 mm, the problem of air flow resistance can be solved.

In addition, by letting the cooling apparatus 1 have the stacked construction, the tubes and fins can be eliminated which are used to constitute the conventional heat dissipating portion. As a result, as there exists no tube needing to be assembled to be inserted into the refrigerant tank portion 1A, no strict dimensional control of component parts is required and therefore the production of component parts is facilitated. In addition, as the adoption of the stacked construction allows the component parts to be assembled from one direction, the automation of the assembling process can be easily arranged.

Furthermore, as the elimination of the conventional tubes obviates the necessity of providing the construction for controlling the inserting amount of the tubes into the refrigerant tank portion 1A on the same refrigerant tank portion, the volume of the refrigerant tank portion which occupies part of the overall volume of the cooling apparatus can be reduced. As a result, the heat dissipating surface area of the cooling apparatus can be expanded to thereby improve the heat dissipating performance thereof. In addition, as the elimination of the tubes can eliminate a risk of adhesion failure of the tubes, there is provided an advantage that a leakage of refrigerant can be prevented.

While the invention has been described by reference to the specific embodiments chosen for purposes of illustration, it should be apparent that numerous modification could be made thereto, by those skilled in the art, without departing from the basic concept and scope of the invention.

What is claimed is:

1. A cooling apparatus boiling and condensing refrigerant, having a refrigerant tank portion having a heat generating element mounted on a surface thereof and adapted to store therein a refrigerant, a refrigerant diffusing portion for diffusing said refrigerant that boils by receiving heat from said heat generating element and a heat exchanging portion provided between said refrigerant tank portion and said refrigerant diffusing portion for executing heat exchange between said boiling refrigerant and a cooling medium and constructed, as a whole, by stacking a number of plate-like members, wherein a first openings that form part of refrigerant passages and second openings that form part of cooling passages are provided in those of said plurality of plate-like members which are used for said heat exchanging portion, said first opening portions being adapted to establish communications with internal spaces of said refrigerant tank portion and said refrigerant diffusing portion.

2. A cooling apparatus boiling and condensing refrigerant as set forth in claim 1, wherein two different types of plate-like members, which are different from each other in at least the location of said second openings, are used for said plate-like members used for said heat exchanging portion, said two types of plate-like members being stacked alternately so that said second openings thereof partly communicate with each other.

3. A cooling apparatus boiling and condensing refrigerant as set forth in claim 2, wherein said two types of plate-like members each have pillar portions which divide said respective second openings, the locations of said pillar portions being different from each other between said two types of plate-like members.

4. A cooling apparatus boiling and condensing refrigerant as set forth in claim 1, wherein inner fins are inserted in said refrigerant passages and said cooling passages or either of them for increasing the heat conducting surface area.

5. A cooling apparatus boiling and condensing refrigerant as set forth in claim 4, wherein said inner fins are each formed into a configuration having an elasticity.

6. A cooling apparatus boiling and condensing refrigerant as set forth in claim 1, wherein the internal capacity of said refrigerant tank portion is set larger than a sum of an internal capacity formed by said first openings of the entirety of said heat exchanging portion and the internal capacity of said refrigerant diffusing portion.

7. A cooling apparatus boiling and condensing refrigerant as set forth in claim 1, wherein said first openings provided in said heat exchanging portion are each constituted by a group of opening holes in which a plurality of opening holes that are each opened in a circular or rectangular configuration are formed in a continuous fashion.

8. A cooling apparatus boiling and condensing refrigerant as set forth in claim 1, wherein tank portions are provided on said plate-like members used for said heat exchanging portion at ends of said second openings, and wherein heat exchanging areas are provided on said plate-like members constituting said refrigerant tank portion and said refrigerant diffusing portion for executing a heat exchange between said cooling medium that flows through said tank portions and said refrigerant.

9. A cooling apparatus boiling and condensing refrigerant as set forth in claim 1, wherein said heat generating element is mounted at a substantially central portion of the surface of said refrigerant tank portion, and wherein the internal capacity of a portion of said refrigerant tank portion which belongs to an area of said refrigerant tank portion which is excluded from an area thereof where said heat generating element is mounted is set larger than the internal capacity of a portion of said refrigerant tank portion which belongs to the area thereof where said heat generating element is mounted.

10. A cooling apparatus boiling and condensing refrigerant as set forth in claim 1, wherein said cooling medium is a liquid such as water.

11. A cooling apparatus boiling and condensing refrigerant, having a refrigerant tank portion having a heat generating element mounted on a surface thereof and adapted to store therein a refrigerant and a heat exchanging portion for executing heat exchange between said refrigerant that boils by receiving heat generated from said heat generating element and a cooling medium and constructed, as a whole, by stacking a number of plate-like members, wherein first openings that form part of refrigerant passages and second openings that form part of cooling passages are provided in said plurality of plate-like members which are used for said heat exchanging portion, said first opening portions being adapted to establish a communication with an internal space of said refrigerant tank portion.

12. A cooling apparatus boiling and condensing refrigerant as set forth in claim 11, wherein two different types of plate-like members, which are different from each other in at least the location of said second openings, are used for said plate-like members used for said heat exchanging portion, said two types of plate-like members being stacked alternately so that said second openings thereof partly communicate with each other.

13. A cooling apparatus boiling and condensing refrigerant as set forth in claim 12, wherein said two types of plate-like members each have pillar portions which divide said respective second openings, the locations of said pillar portions being different from each other between said two types of plate-like members.

14. A cooling apparatus boiling and condensing refrigerant as set forth in claim 11, wherein inner fins are inserted in said refrigerant passages and said cooling passages or either of them for increasing the heat conducting surface area.

15. A cooling apparatus boiling and condensing refrigerant as set forth in claim 14, wherein said inner fins are each formed into a configuration having elasticity.

16. A cooling apparatus boiling and condensing refrigerant as set forth in claim 11, wherein said cooling medium is liquid such as water.

* * * * *

UNITED STATES PATENT AND TRADEMARK OFFICE

CERTIFICATE OF CORRECTION

PATENT NO. : 6,742,574 B2
DATED : June 1, 2004
INVENTOR(S) : Hajime Sugito et al.

It is certified that error appears in the above-identified patent and that said Letters Patent is hereby corrected as shown below:

Title page,
Item [75], Inventors, should be:
-- Hajime Sugito, Nagoya (JP)
Hiroyuki Osakabe, Chita-gun (JP)
Shinichi Morihira, Kariya (JP)
Takaki Okochi, Chiryu (JP)
Yuhei Kunikata, Kariya (JP) --

Column 20,
Line 32, delete "a".

Signed and Sealed this

Twenty-eighth Day of September, 2004

JON W. DUDAS
*Director of the United States Patent and Trademark Office*